US008151879B2

(12) United States Patent
Heller et al.

(10) Patent No.: US 8,151,879 B2
(45) Date of Patent: Apr. 10, 2012

(54) ZONE ISOLATION ASSEMBLY AND METHOD FOR ISOLATING A FLUID ZONE IN AN EXISTING SUBSURFACE WELL

(75) Inventors: Noah R. Heller, Corte Madera, CA (US); Peter F. Moritzburke, Corte Madera, CA (US)

(73) Assignee: BESST, Inc., San Rafael, CA (US)

( * ) Notice: Subject to any disclaimer, the term of this patent is extended or adjusted under 35 U.S.C. 154(b) by 248 days.

(21) Appl. No.: 12/392,983

(22) Filed: Feb. 25, 2009

(65) Prior Publication Data

US 2009/0223681 A1 Sep. 10, 2009

Related U.S. Application Data

(63) Continuation-in-part of application No. 11/700,991, filed on Jan. 31, 2007, now abandoned.

(60) Provisional application No. 60/765,249, filed on Feb. 3, 2006.

(51) Int. Cl.
*E21B 49/08* (2006.01)
*E21B 33/12* (2006.01)

(52) U.S. Cl. ..... 166/264; 166/179; 166/241.7; 166/242.6

(58) Field of Classification Search ..... 166/250.01, 166/179, 264, 241.7, 242.6
See application file for complete search history.

(56) References Cited

U.S. PATENT DOCUMENTS 1,323,379 A 12/1919 Rigby
1,916,875 A 7/1933 Yarbrough
2,128,253 A 8/1937 Johnson
2,137,296 A 11/1938 Macready
2,190,250 A 2/1940 Blackburn
2,227,539 A 1/1941 Dorton
2,414,254 A 1/1947 Busby
2,703,144 A 3/1955 Clifford
2,776,013 A 1/1957 Tausch
2,876,708 A 3/1959 Frost
2,946,387 A 7/1960 Hooker
3,002,828 A 10/1961 Fino et al.
3,152,639 A 10/1964 Pearcy
3,570,600 A * 3/1971 Wall ..... 166/217
3,969,937 A 7/1976 Barrington et al.
4,335,786 A 6/1982 Smith
4,352,394 A 10/1982 Zehren
4,425,965 A 1/1984 Bayh et al.
4,475,595 A 10/1984 Watkins et al.
(Continued)

*Primary Examiner* — Cathleen Hutchins
(74) *Attorney, Agent, or Firm* — James P. Broder; Roeder & Broder LLP

(57) ABSTRACT

A zone isolation assembly for a fluid monitoring system in an existing subsurface well includes a fluid receiving pipe, a docking receiver, a docking apparatus and a first sealer. The fluid receiving pipe includes a pipe interior and a fluid inlet structure. The fluid receiving pipe receives a fluid through the fluid inlet structure into the pipe interior. The docking receiver is connected to the fluid receiving pipe. The docking apparatus moves between (i) a docked position wherein the docking apparatus is docked with the docking receiver, and (ii) an undocked position wherein the docking apparatus is undocked with the docking receiver. The first sealer is spaced apart from the docking apparatus. In certain embodiments, the first sealer selectively forms a fluid-tight seal between the fluid receiving pipe and the casing to divide the fluid zone into a first zone and a spaced apart second zone. The first zone and the second zone are not in fluid communication with one another when the docking apparatus is in the docked position.

39 Claims, 19 Drawing Sheets

U.S. PATENT DOCUMENTS 4,489,779 A 12/1984 Dickinson
4,701,107 A 10/1987 Dickinson
4,724,434 A 2/1988 Hanson et al.
4,942,923 A 7/1990 Geeting
4,995,456 A 2/1991 Cornette et al.
5,186,048 A 2/1993 Foster et al.
5,293,931 A 3/1994 Nichols et al.
5,293,934 A 3/1994 Burge et al.
5,450,900 A 9/1995 Schalla et al.
5,473,939 A 12/1995 Leder et al.
5,687,791 A 11/1997 Beck et al.
5,708,220 A 1/1998 Burge
5,799,733 A * 9/1998 Ringgenberg et al. ..... 166/264
5,829,520 A 11/1998 Johnson
5,909,773 A 6/1999 Koehler et al.
6,158,516 A 12/2000 Smith et al.
6,301,959 B1 10/2001 Hrametz et al.
6,508,310 B1 1/2003 Mioduszeweski et al.
6,619,931 B2 9/2003 Anderson
6,668,925 B2 12/2003 Shaw et al.
6,668,943 B1 12/2003 Maus et al.
6,722,432 B2 4/2004 Spiers et al.
6,745,835 B2 6/2004 Fields
6,935,356 B2 8/2005 Shepard et al.
6,962,197 B2 11/2005 Khonymets
7,004,252 B2 2/2006 Vise, Jr.
7,111,682 B2 9/2006 Blaisdell
7,320,364 B2 1/2008 Fairbanks
7,461,547 B2 12/2008 Terabayashi et al.
2002/0003038 A1 1/2002 Bussear et al.
2002/0053438 A1 5/2002 Williamson, Jr.
2002/0166663 A1 11/2002 Last et al.
2003/0127227 A1 7/2003 Fehr et al.
2004/0050548 A1 3/2004 Dybdahl
2004/0134663 A1 7/2004 Khomynets
2005/0028974 A1 2/2005 Moody
2005/0051329 A1 3/2005 Blaisdell
2005/0224229 A1 10/2005 Blacklaw
2007/0007005 A1 1/2007 Heller et al.

* cited by examiner 54
56
52
50
16
26
35
32
34
14
30
12
28
38
18
36
40
10
25S
24
22
20
25F
42

35
44
46
48
34
32
10

16L
16D
10

25
16
30
20
10

310
330
314
358
338
328
360

334

332
322
325F

ZONE ISOLATION ASSEMBLY AND METHOD FOR ISOLATING A FLUID ZONE IN AN EXISTING SUBSURFACE WELL

RELATED APPLICATION

This application is a continuation-in-part of U.S. patent application Ser. No. 11/700,991, filed on Jan. 31, 2007 now abandoned, which claims the benefit of U.S. Provisional Application Ser. No. 60/765,249, filed on Feb. 3, 2006. The contents of U.S. patent application Ser. No. 11/700,991 and U.S. Provisional Application Ser. No. 60/765,249 are incorporated herein by reference.

BACKGROUND

Standard installation procedures for subsurface wells (sometimes referred to herein simply as 'wells') have been established in the environmental industry. In the early years following the establishment of the United States EPA program in the US (ca. 1980), many monitoring wells were of a 4-inch diameter or greater for the purpose of accommodating readily available fluid pumps that were used in the water resources business, for example, with these pumps being of a 3-inch diameter and greater. In the mid to late 1980s, smaller diameter pumps were developed specifically for groundwater monitoring applications. As a result, the environmental industry found it possible to reduce monitoring well installation costs by installing 2-inch diameter monitoring wells to accommodate these smaller diameter fluid purging and sampling pumps. Drilling machines that were used for the 2-inch and greater diameter wells were typically auger, rotary or casing drive based technologies—such as hollow stem auger, mud rotary and air rotary, air rotary casing hammer, dual wall percussion and even sonic. These drilling technologies often remove large quantities of soil, rock, and formation fluid to advance a well bore. The costs associated with drilling, containerizing and disposing of these materials can be significant.

Given the expense of using these types of large drilling machines, direct push drilling technology emerged as a viable technology in the early 1990s—making it possible to reduce costs even further for shallow drilling projects typically ranging between 10 to 60 feet below ground surface (and even deeper with cone penetrometer (CPT) machines). One feature of the direct push drilling method was the minimization of drill cuttings and fluids by means of simply displacing the unconsolidated sediment to the side of a drive cone or point during borehole advancement, as opposed to removing the cuttings and fluids from the borehole. A key requirement in accomplishing this procedure was to reduce the diameter of the drive cone and drive rod to diameters typically less than 1.5 to 2-inches in order to reduce frictional surface area which is critical for direct push borehole advancement. As a result of the direct push technology, relatively small diameter monitoring wells could be installed to shallow depths at significant cost savings compared to 2-inch and 4-inch monitoring wells installed with more traditional drilling technologies (described above).

Fluid monitoring wells consist of a riser pipe with an attached fluid inlet structure at a bottom end of the riser pipe, and are normally of a diameter of at least 2 inches. They are installed in the ground to a depth of a fluid to be sampled and with the fluid inlet structure being of an appropriate length. Once the well structure is in place with the desired configuration, fluid from one zone flows into the riser pipe and rises to an equilibrium point within the pipe. Fluid is then sampled from within the riser pipe using various methods. Unfortunately, a problem with the above-described drilling technologies is that there is no isolation of well bore fluids between the riser pipe and fluid inlet structure of the fluid monitoring well, regardless of diameter.

With conventional technology, it is difficult or impossible to cost-effectively and properly isolate the standing fluid in the riser pipe from the desired fluid in the fluid inlet structure. Therefore, it is entirely possible for the stagnant and possibly non-representative fluid in the riser pipe to mix with the fluid in the fluid inlet structure during purging and sampling. As a result, the collected fluid samples may be altered or biased to provide a non-representative result.

In an effort to reduce the negative impact to these fluid samples and increase the likelihood of relatively representative results, environmental regulations within the fluid monitoring industry require certain amounts of fluid be purged from the riser pipe prior to sampling to remove stagnant standing fluid and/or fluid that is non-representative. Many branches of state and local environmental agencies still require that at least 3 to 5 wet casing volumes be removed from the well structure as a means of eliminating all of the stagnant and non-representative fluid from the fluid inlet structure and riser pipe zones. Hence, there is significant fluid drawdown inside the well to facilitate this process. As stagnant and/or non representative fluid is removed, new fluid is drawn into the riser pipe from the fluid inlet structure. In theory, the intent of this process is to increase the likelihood that the fluid samples taken will statistically reflect actual fluid conditions. The downside to using this procedure, however, is that it is necessary to remove (purge) substantial quantities of fluid at a significant cost.

Many state and local agencies now allow a procedure called "low-flow sampling" as a common practice for the purpose of reducing the amount of fluid purged when using 3 to 5 wet casing volumes. Low-flow sampling requires that the fluid within the riser pipe not be drawn down significantly during the sampling event. Therefore, the recharge rate of fluid into the riser pipe from the intake area must be nearly equal to the rate of fluid discharged during purging and sampling. This can require monitoring of actual drawdown during sampling by means of an electrical or fiber optic transducer inserted into the well to detect changes in fluid level.

SUMMARY

The present invention is directed toward a zone isolation assembly for a fluid monitoring system in an existing subsurface well. The subsurface well includes a casing and a fluid zone. In one embodiment, the zone isolation assembly includes a fluid receiving pipe, a docking receiver, a docking apparatus and a first sealer. The fluid receiving pipe includes a pipe interior and a fluid inlet structure. The fluid receiving pipe receives a fluid through the fluid inlet structure into the pipe interior. The docking receiver is connected to the fluid receiving pipe. The docking apparatus moves between (i) a docked position wherein the docking apparatus is docked with the docking receiver, and (ii) an undocked position wherein the docking apparatus is undocked with the docking receiver. The first sealer is spaced apart from the docking apparatus. In certain embodiments, the first sealer selectively forms a fluid-tight seal between the fluid receiving pipe and the casing to divide the fluid zone into a first zone and a spaced apart second zone. The first zone and the second zone are not in fluid communication with one another when the docking apparatus is in the docked position.

In one embodiment, the docking receiver is removably positioned within the casing. The docking apparatus can include a pump assembly for moving the fluid away from the first zone. The docking apparatus can also include a sensor apparatus for sensing various fluid properties. In certain embodiments, the first sealer can be a time-release bentonite pellet bag. Alternatively, the first sealer can be an inflatable packer, or it can include a plurality of flanges that contact the casing to form a seal. In one embodiment, at least one of the flanges has an angled contact region that contacts the casing so that the flange is angled relative to the casing. The fluid receiving pipe can have a consistent diameter or one that varies along a length of the fluid receiving pipe. The pipe interior can include a filling material that decreases a fluid volume within the pipe interior. The filling material can include sand, crushed rock or other materials.

In another embodiment, the zone isolation assembly can include a second sealer that is spaced apart from the first sealer. In this embodiment, the second sealer selectively forms a fluid-tight seal between the fluid receiving pipe and the casing so that the first zone is at least partially bounded by the second sealer. In one embodiment, the fluid receiving pipe is positioned substantially between the first sealer and the second sealer. In another embodiment, the zone isolation assembly can include a deployment device that positions the docking receiver relative to the casing. The deployment device can include an engagement pin that engages the docking receiver during positioning of the docking receiver relative to the casing. The docking receiver can include a pin receiver that receives the engagement pin from the deployment device during engagement between the docking receiver and the deployment device. Further, the docking receiver can also include a pin retainer. In one embodiment, the deployment device is adapted to be rotated so that the engagement pin is retained by the pin retainer during positioning of the docking receiver relative to the casing.

In another embodiment, the zone isolation assembly can include a fluid collector that is coupled to the docking receiver. The fluid collector collects the fluid for transport to the docking apparatus. In still another embodiment, the first sealer can include an upper section and a lower section that selectively engage one another to form the seal between the fluid receiving pipe and the casing. In one embodiment, the fluid receiving pipe is a telescoping fluid receiving pipe. In an alternative embodiment, the zone isolation assembly also includes a riser pipe that guides the docking apparatus toward the docking receiver. The riser pipe is secured to the docking receiver and extends away from the docking receiver in a direction away from the first zone.

The present invention is also directed toward a method for isolating a first zone from a second zone within an existing subsurface well.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figures 1A, 1B, 1C, 1D:
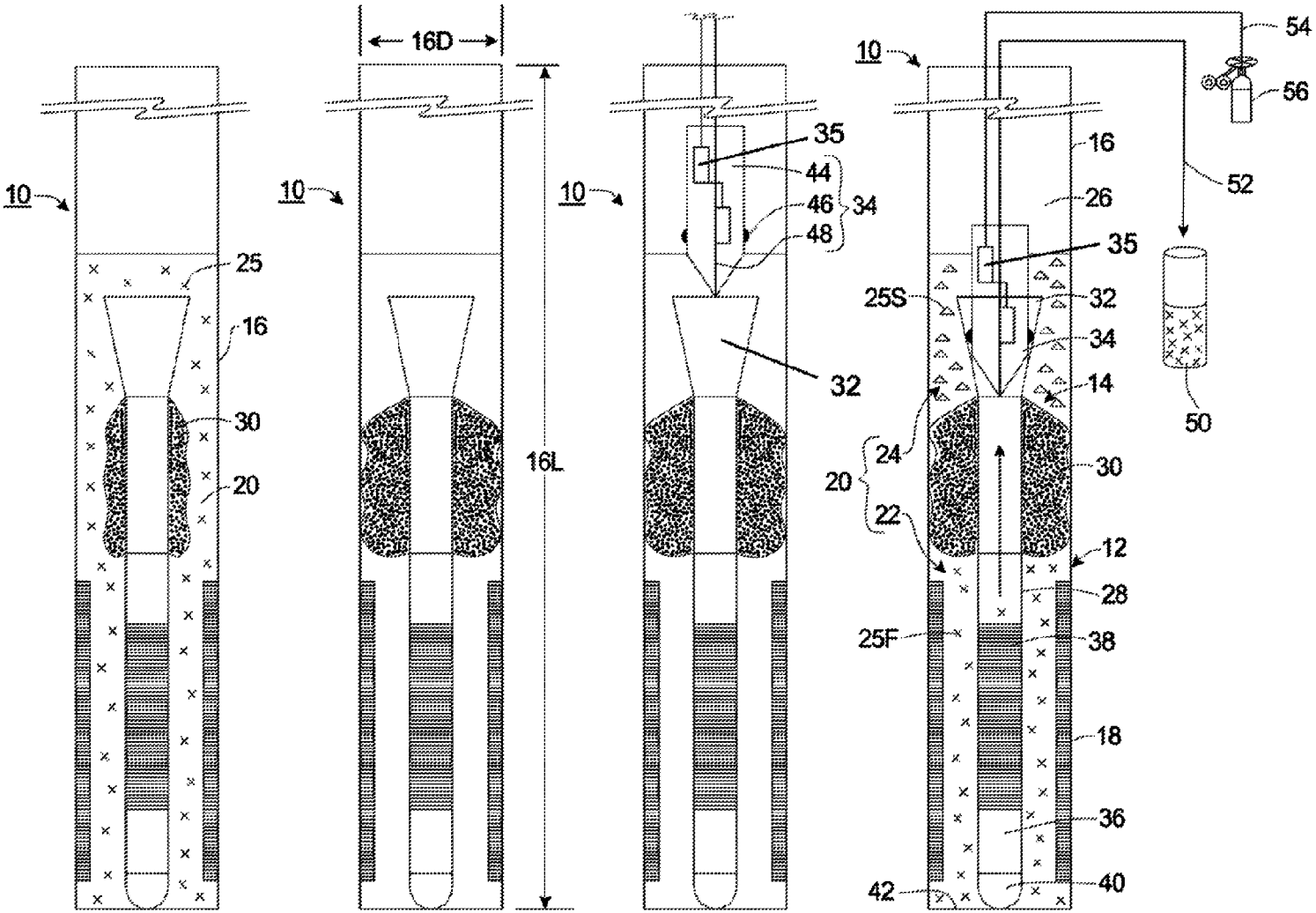
FIGS. 1A-D illustrate schematic views of various stages of installation of one embodiment of a fluid monitoring system including a zone isolation assembly having features of the present invention.

As an overview, the fluid monitoring systems 10 described herein include subsurface well conversion and retrofit technology to substantially reduce purge volumes in existing subsurface wells 12. Many of the embodiments illustrated and described herein can isolate sampling zones and fluid sensor targets, and can include integrated purging and sampling devices. It should be noted that the Figures provided herein are not drawn to scale given the extreme heights of the fluid monitoring systems 10 relative to their widths.

FIGS. 1A-D illustrate schematic views of various stages of installation of one embodiment of a fluid monitoring system 10 (also sometimes referred to herein as a "system") for a subsurface well 12. In the embodiment illustrated in various portions of FIGS. 1A-D, the fluid monitoring system 10 includes a zone isolation assembly 14. The subsurface well 12 includes a casing 16 (also sometimes referred to as a "riser pipe"), which can include any casing 16 that can be utilized in subsurface wells 12 known to those skilled in the art. The casing 16 can be formed from any suitable material, such as various plastics, metals, composites or any other appropriate material. The casing 16 can have any suitable dimensions. For example, the casing 16 can have a length 16L that extends approximately 10 feet or less below ground surface (bgs). Alternatively, the length 16L of the casing 16 can extend up to or exceeding several thousand feet bgs. Further, the casing 16 can have a diameter 16D of approximately 4 inches or less. Alternatively, the casing 16 can have a diameter that is greater than 4 inches. Still alternatively, the diameter 16D of the casing 16 can vary along the length 16L of the casing 16. The fluid monitoring system 10 and/or the zone isolation assembly 14 provided herein can function equally well in conjunction with casings 16 of any length 16L and/or diameter 16D.

Typically, the casing 16 includes a fluid intake device 18 positioned at or near a fluid zone 20 in the well 12. Under certain circumstances described in greater detail below, the fluid zone 20 can include a first zone 22 and a second zone 24 that are isolated from one another so that the first zone 22 and the second zone 24 are not in fluid communication with one another and are two clearly delineated zones 22, 24. In this embodiment, the first zone 22 contains a first fluid 25F (represented by X's in FIGS. 1A and 1D) and the second zone contains a second fluid 25S (represented by triangles in FIG. 1D). Alternatively, the fluid zone 20 may not be divided into two clearly delineated zones 22, 24. Stated another way, the first zone 22 and the second zone 24 can be in fluid communication with one another so that there is no specific division between the first zone 22 and the second zone 24. Generally, the fluid zone 20 is positioned at least partially at a level that is adjacent to a fluid 25 such as groundwater or other fluids 25 to be monitored. The fluid intake device 18 allows fluid 25 within rock, soil, another subterranean formation, or a body of water, to enter into an interior 26 of the casing 16.

The design of the zone isolation assembly 14 can vary to suit the design requirements of the fluid monitoring system 10. In the embodiment illustrated in FIGS. 1A-D, the zone isolation assembly 14 includes a fluid receiving pipe 28, a sealer 30, a docking receiver 32, a docking apparatus 34 and a pump assembly 35. The fluid receiving pipe 28 is adapted to be moved into position within the casing 16. The fluid receiving pipe 28 includes a hollow pipe interior 36, a fluid inlet structure 38 and an end cap 40. The fluid receiving pipe 28 receives the fluid 25 from the fluid zone 20, through the fluid inlet structure 38, into the pipe interior 36. In one non-exclusive embodiment, the fluid receiving pipe 28 can be formed from a polyvinylchloride (PVC) material and can be any desired thickness, such as Schedule 40, Schedule 80, etc. Alternatively, the fluid receiving pipe 28 can be formed from other plastics, fiberglass, ceramic, metal, etc.

The fluid inlet structure 38 can include a screen, perforations, slots, or other suitable openings for the fluid 25 to migrate from the casing interior 26 into the pipe interior 36. Once the fluid 25 has entered the pipe interior 36, the fluid 25 can travel upward either actively or passively through the fluid receiving pipe 28 as described in greater detail below.

The end cap 40 can rest on a solid surface of the formation at a bottom surface 42 of the well 12 to at least partially support a portion or all of the zone isolation assembly 14. Alternatively, the end cap can "float" above the bottom surface 42 of the well 12 without resting on any solid surface. Additionally, the end cap 40 can inhibit fluid and/or solids from entering through a bottom end of the fluid receiving pipe 28. Further, the end cap 40 can include a pipe or rod that extends downward any appropriate length to assist an operator of the system 10 in determining when the zone isolation assembly 14 has reached the desired position within the well 12. For example, a bottom of the fluid intake device 18 may be positioned 10 feet from the bottom of the well 12, in which case the end cap 40 may have a length of approximately 10 feet so that the fluid inlet structure 38 is properly positioned.

The sealer 30 selectively forms a seal between the fluid receiving pipe 28 and the casing 16 to divide the fluid zone 20 into the first zone 22 and the second zone 24. Additionally, or alternatively, the sealer 30 can selectively stabilize and/or secure the positioning of the zone isolation assembly 14 relative to the casing 16. The specific type of sealer 30 utilized with the zone isolation assembly 14 can vary to suit the design requirements of the zone isolation assembly 14 and the fluid monitoring system 10. In this embodiment, the sealer 30 moves from an unsealed position (as illustrated in FIG. 1A) to a sealed position (illustrated in FIGS. 1B-1D). In one embodiment, the sealer 30 includes a bentonite pellet bag that is secured to the fluid receiving pipe 28 and/or the docking receiver 32. In this embodiment, the sealer 30 can have a time-release formulation that causes the bentonite pellets of the sealer 30 to swell when in contact with the fluid 25. In non-exclusive alternative embodiments, the sealer 30 can include other known types of sealing apparatuses.

In the unsealed position, the sealer 30 does not form a seal between the fluid receiving pipe 28 and the casing 16, and the fluid 25 can move freely within the fluid zone 20. In the sealed position, the sealer 30 forms a verifiable seal between the fluid receiving pipe 28 and the casing 16. Further, in the sealed position, the sealer 30 can effectively divide the fluid zone 20 into the first zone 22 and the second zone 24 depending upon the positioning of the docking apparatus 34, as set forth below.

In certain embodiments, the sealer 30 is at least partially positioned at the uppermost portion of the first zone 22. In other words, a portion of the first zone 22 is at least partially bounded by the sealer 30. Further, the sealer 30 can also be positioned at the lowermost portion of the second zone 24. In this embodiment, a portion of the second zone 24 is at least partially bounded by the sealer 30.

The docking receiver 32 receives the docking apparatus 34. The design of the docking receiver 32 can vary depending upon the design requirements of the docking apparatus 34 and the fluid monitoring system 10. In the embodiment illustrated in FIGS. 1A-D, the docking receiver 32 is fixedly secured to the fluid receiving pipe 28. In various embodiments, the docking receiver 32 is threadedly secured to the fluid receiving pipe 28. In non-exclusive alternative embodiments, the docking receiver 32 can be secured to the fluid inlet structure 38 and/or the fluid receiving pipe 28 in other suitable ways, such as by an adhesive material, welding, fasteners, or by integrally forming or molding the docking receiver 32 with one or both of the fluid inlet structure 38 and at least a portion of the fluid receiving pipe 28. Stated another way, the docking receiver 32 can be uniformly formed with the fluid inlet structure 38 and/or at least a portion of the fluid receiving pipe 28.

The docking apparatus 34 selectively docks with the docking receiver 32 to form a substantially fluid-tight seal between the docking apparatus 34 and the docking receiver 32. The design and configuration of the docking apparatus 34 as provided herein can be varied to suit the design requirements of the docking receiver 32 and the fluid monitoring system 10. In various embodiments, the docking apparatus 34 moves from an undocked position wherein the docking apparatus 34 is not docked or otherwise engaged with the docking receiver 32, to a docked position wherein the docking apparatus 34 is docked with the docking receiver 32.

In the undocked position (illustrated in FIG. 1C), the first fluid 25F and the second fluid 25S are not isolated from one another. In other words, the first zone 22 and the second zone 24 are in fluid communication with one another. In the undocked position, fluid 25 can flow through the fluid inlet structure 38 into the pipe interior 36 of the fluid receiving pipe 28, and upward through the docking receiver 32 so that the fluid is effectively above the sealer 30.

However, when the sealer 30 is in the sealed position and the docking apparatus is in the docked position (as illustrated in FIG. 1D), the first fluid 25F and the second fluid 25S are isolated from one another. Stated another way, in the embodiment illustrated in FIG. 1D, the first zone 22 and the second zone 24 are not in fluid communication with one another.

In the embodiment illustrated in FIG. 1C, for example, the docking apparatus 34 can include a docking weight 44, a resilient seal 46 and a fluid channel 48. In various embodiments, the docking weight 44 has a specific gravity that is greater than water. In non-exclusive alternative embodiments, the docking weight 44 can be formed from materials so that the docking apparatus has an overall specific gravity that is at least approximately 1.50, 2.00, 2.50, 3.00, or 4.00. In certain embodiments, the docking weight 44 can be formed from materials such as metal, ceramic, epoxy resin, rubber, nylon, Teflon, Nitrile, Viton, glass, plastic or other suitable materials having the desired specific gravity characteristics.

In various embodiments, the resilient seal 46 is positioned around a circumference of the docking weight 44. The resilient seal 46 can be formed from any resilient material such as rubber, urethane or other plastics, certain epoxies, or any other material that can form a substantially fluid-tight seal with the docking receiver 32. In one non-exclusive embodiment, for example, the resilient seal 46 is a rubberized O-ring. In this embodiment, because the resilient seal 46 is in the form of an O-ring, a relatively small surface area of contact between the resilient seal 46 and the docking receiver 32 occurs. As a result, a higher force in pounds per square inch (psi) is achieved. For example, a fluid-tight seal between the docking receiver 32 and the resilient seal 46 can be achieved with a force that is less than approximately 1.00 psi. In non-exclusive alternative embodiments, the force can be less than approximately 0.75, 0.50, 0.40 or 0.33 psi. Alternatively, the force can be greater than 1.00 psi or less than 0.33 psi.

The fluid channel 48 can be a channel or other type of conduit for the first fluid 25F to move through the docking weight 44, in a direction from the fluid inlet structure 38 toward the docking weight 44. In one embodiment, the fluid channel 48 can be tubular and can have a substantially circular cross-section. Alternatively, the fluid channel 48 can have another suitable configuration. The positioning of the fluid channel 48 within the docking weight 44 can vary. In one embodiment, the fluid channel 48 can be generally centrally positioned within the docking weight 44 so that the first fluid 25F flows substantially centrally through the docking weight 44. Alternatively, the fluid channel 48 can be positioned in an off-center manner.

The pump assembly 35 pumps the first fluid 25F that enters the pump assembly 35 to a sample receiver 50 via a sample outlet line 52. The design and positioning of the pump assembly 35 can vary. In one embodiment, the pump assembly 35 is a highly robust, miniaturized low flow pump that can easily fit into relatively small diameter wells 12, although the pump assembly 35 is also adaptable to be used in larger diameter wells 12.

In the embodiment illustrated in FIGS. 1A-1D, the pump assembly 35 can include one or more one-way valves (not shown in FIGS. 1A-1D) such as those found in a single valve parallel gas displacement pump, double valve pump, bladder pump, electric submersible pump and/or other suitable pumps, that are utilized during pumping of the first fluid 25F to the sample receiver 50. The one way valve(s) allow the first fluid 25F to move from the first zone 22 toward the sample outlet line 52, without the first fluid 25F moving in the opposite direction. These types of one-way valves can include poppet valves, reed valves, electronic valves, electromagnetic valves and/or check valves, for example. In various embodiments, a gas inlet line 54 can extend to the pump assembly 35, and the sample outlet line 52 extends from the pump assembly 35.

As explained in greater detail below, during a purge cycle, a gas (not shown) such as nitrogen, helium, etc., from a gas source 56 is delivered down the gas inlet line 54 to the pump assembly 35 to force the first fluid 25F upward that has migrated to the pump assembly 35 during equilibration through the sample outlet line 52 to the sample receiver 50. During a recharge cycle, the gas is turned off.

The pump assembly 35 can be coupled to the docking apparatus 34 so that removal of the docking apparatus 34 from the well 12 likewise results in simultaneous removal of the pump assembly 35 from the well 12. In an alternative embodiment, the pump assembly 35 can be incorporated as part of the docking apparatus 34 within a single structure. In this embodiment, the docking apparatus 34 can house the pump assembly 35, thereby obviating the need for two separate structures (docking apparatus 34 and pump assembly 35). Instead, in this embodiment, only one structure would be used which would serve the purposes described herein for the docking apparatus 34 and the pump assembly 35. In one embodiment, the pump assembly 35 can have both the shape and the weight of the docking apparatus 34 so that the pump assembly 35 can be positioned in the engaged position relative to the docking receiver 32.

The docking apparatus 34 can be lowered into the well 12 from the surface. In certain embodiments, the docking apparatus 34 utilizes the force of gravity to move down the casing 16 and dock with the docking receiver 32. The docking apparatus 34 can therefore move through any fluid 25 present in the casing 16 and into the docked position with the docking receiver 32. Alternatively, the docking apparatus 34 can be forced down the fluid receiving pipe 28 and into the docked position by another suitable means.

The docking apparatus 34 is moved from the docked position to the undocked position by exerting a force on the docking apparatus 34 against the force of gravity, such as by pulling in a substantially upward manner, e.g., in a direction away from the docking receiver 32 and the fluid inlet structure 38. The docking apparatus 34 can be secured to a tether or other suitable line to break or otherwise disrupt the seal between the resilient seal 46 and the docking receiver 32.

To summarize various stages of installation for this embodiment, FIG. 1A illustrates a portion of the zone isolation assembly 14 with the sealer 30 in the unsealed position, and no docking apparatus in the vicinity. FIG. 1B illustrates a portion of the zone isolation assembly 14 with the sealer 30 in the sealed position, and no docking apparatus 34 in the vicinity. FIG. 1C illustrates the zone isolation assembly 14 with the sealer 30 in the sealed position, and the docking apparatus 34 in the vicinity but in the undocked position. FIG. 1D illustrates the zone isolation assembly 14 with the sealer 30 in the sealed position, and the docking apparatus 34 in the docked position. In FIG. 1D, the first fluid 25F is ready for purging from the first zone 22 to the surface.

Figures 2A, 2B, 2C, 2D:
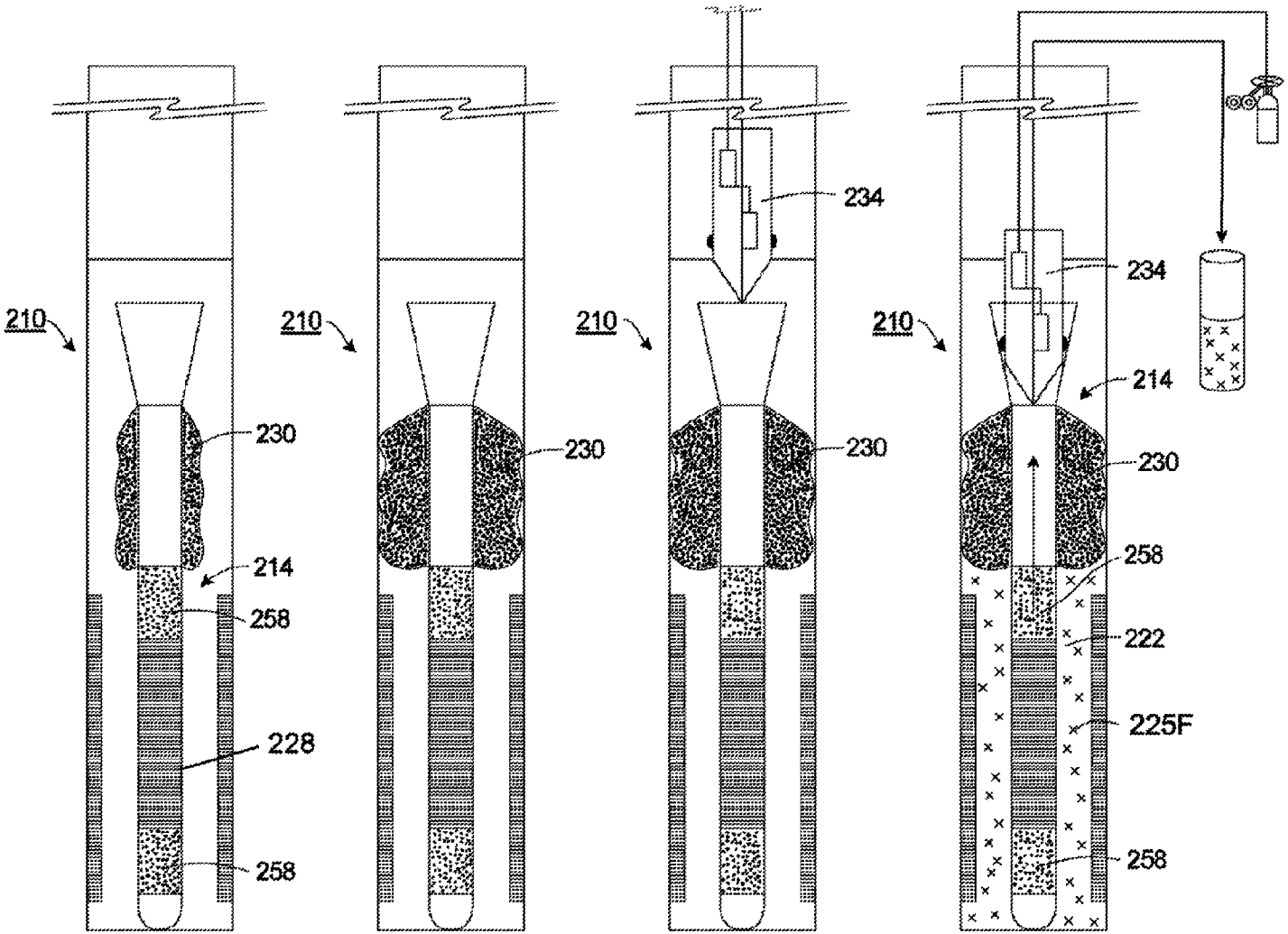
FIGS. 2A-D illustrate schematic views of various stages of installation of another embodiment of the fluid monitoring system.

FIGS. 2A-D illustrate schematic views of various stages of installation of another embodiment of the fluid monitoring system 210. FIG. 2A illustrates a portion of a zone isolation assembly 214 with a sealer 230 in the unsealed position, and no docking apparatus in the vicinity. FIG. 2B illustrates a portion of the zone isolation assembly 214 with the sealer 230 in the sealed position, and no docking apparatus in the vicinity. FIG. 2C illustrates the zone isolation assembly 214 with the sealer 230 in the sealed position, and a docking apparatus 234 in the vicinity but in the undocked position. FIG. 2D illustrates the zone isolation assembly 214 with the sealer 230 in the sealed position, and the docking apparatus 234 in the docked position. In FIG. 2D, a first fluid 225F is ready for purging from a first zone 222 up to the surface.

In this embodiment, the zone isolation assembly 214 includes a filling material 258, i.e. sand, crushed rock, or other suitable fluid permeable materials, that is positioned within at least a portion of the fluid receiving pipe 228 to reduce a fluid volume of the first fluid 225F within the first zone 222. With this design, the purge volume, e.g., the potential fluid volume within the first zone 222, is decreased. Additionally, the time necessary to purge the first fluid 225F from the first zone 222 is also reduced.

Figures 3A, 3B, 3C, 3D:
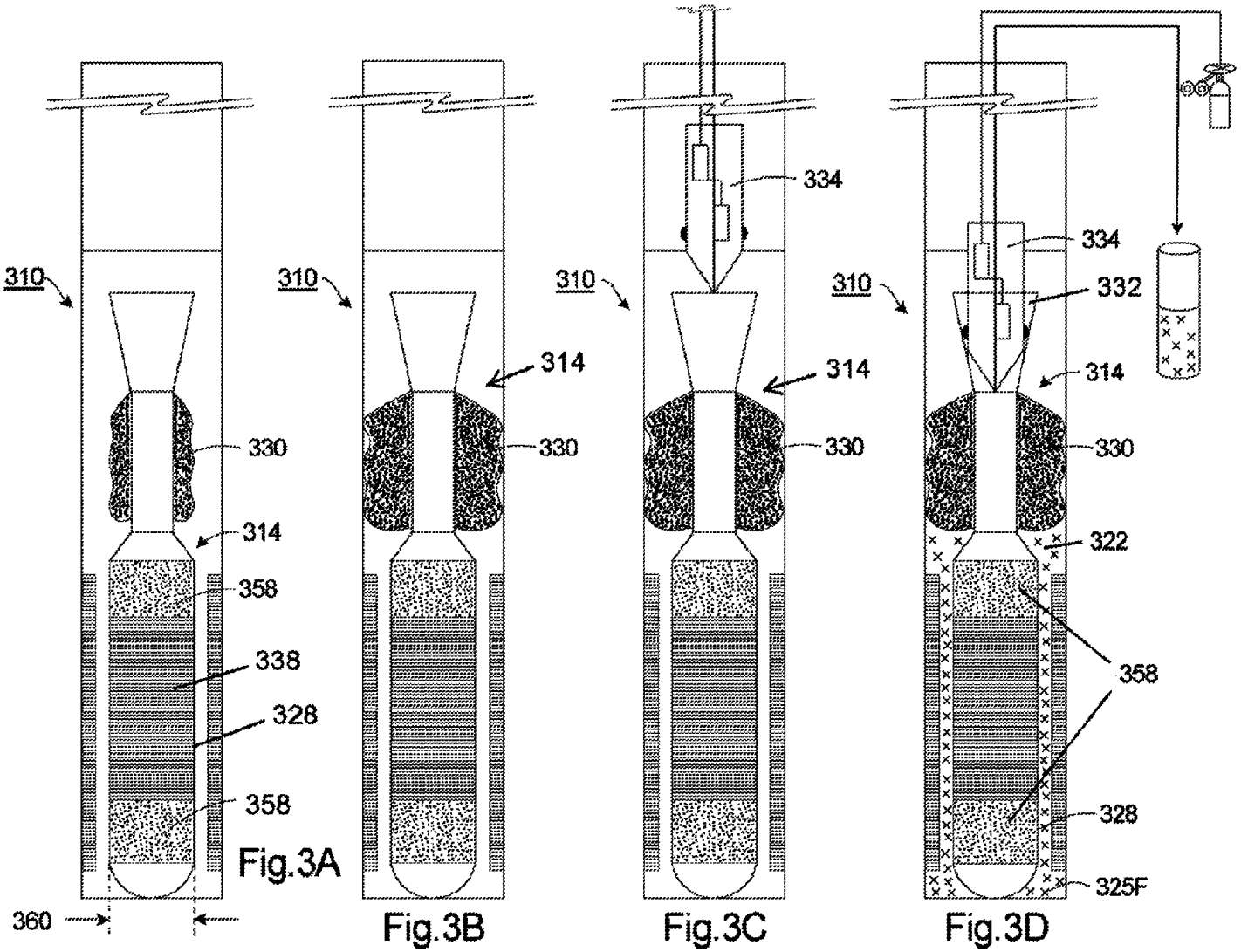
FIGS. 3A-D illustrate schematic views of various stages of installation of yet another embodiment of the fluid monitoring system.

FIGS. 3A-D illustrate schematic views of various stages of installation of still another embodiment of the fluid monitoring system 310. FIG. 3A illustrates a portion of a zone isolation assembly 314 with a sealer 330 in the unsealed position, and no docking apparatus in the vicinity. FIG. 3B illustrates a portion of the zone isolation assembly 314 with the sealer 330 in the sealed position, and no docking apparatus in the vicinity. FIG. 3C illustrates the zone isolation assembly 314 with the sealer 330 in the sealed position, and a docking apparatus 334 in the vicinity but in the undocked position. FIG. 3D illustrates the zone isolation assembly 314 with the sealer 330 in the sealed position, and the docking apparatus 334 in the docked position with the docking receiver 332. In FIG. 3D, a first fluid 325F is ready for purging from a first zone 322 up to the surface.

In this embodiment, the zone isolation assembly 314 includes a filling material 358 that is positioned within the fluid receiving pipe 328 to reduce a fluid volume of the first fluid 325F within the first zone 322. However, in this embodiment, the fluid receiving pipe 328 has a pipe diameter 360 (illustrated in FIG. 3A) that varies. For example, in this embodiment, the pipe diameter 360 is greater in the area of the fluid inlet structure 338. With this design, the purge volume is decreased even further. Consequently, the time necessary to purge the first fluid 325F from the first zone 322 is also reduced even further.

Figures 4A, 4B, 4C, 4D:
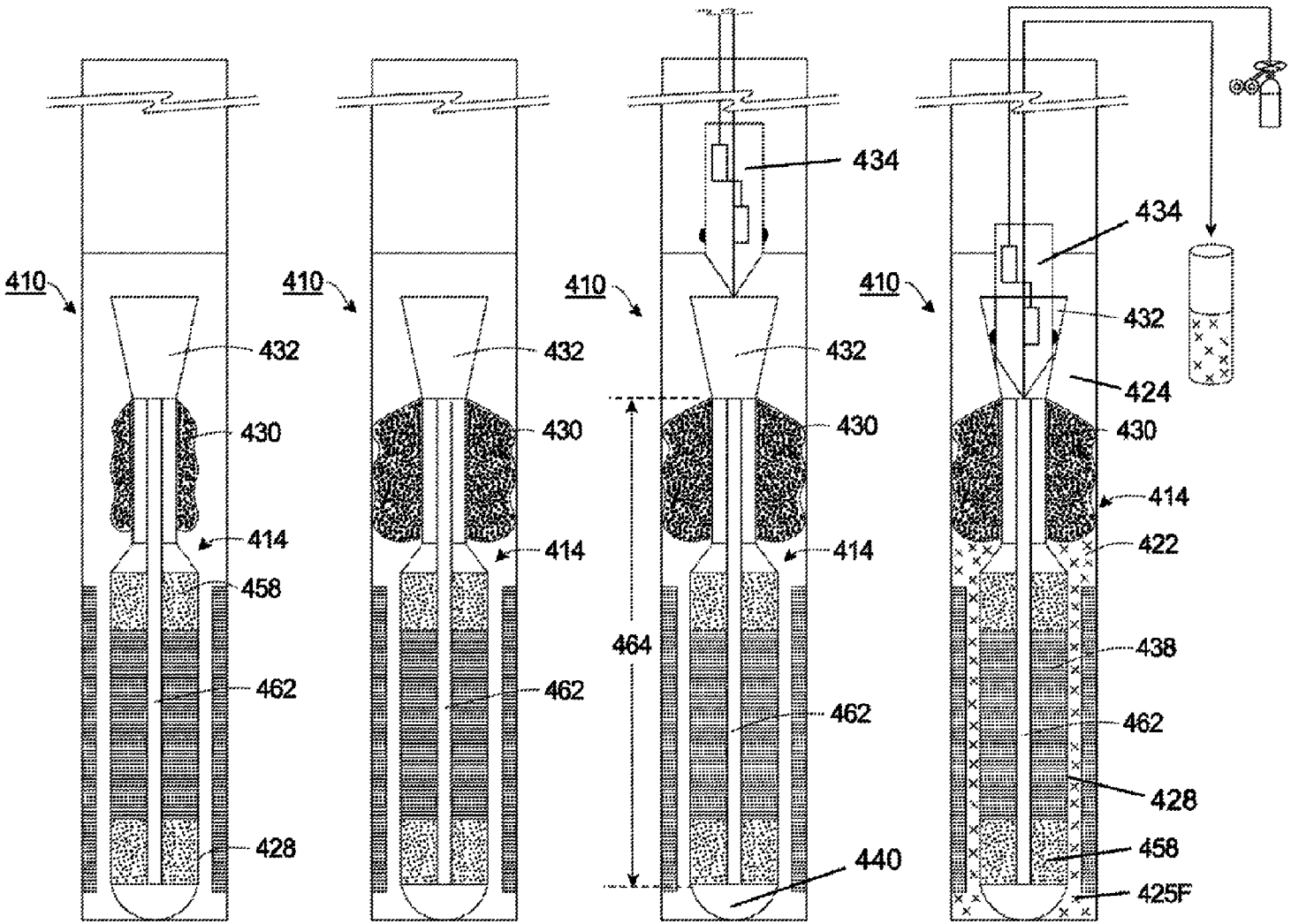
FIGS. 4A-D illustrate schematic views of various stages of installation of still another embodiment of the fluid monitoring system.

FIGS. 4A-D illustrate schematic views of various stages of installation of still another embodiment of the fluid monitoring system 410. FIG. 4A illustrates a portion of a zone isolation assembly 414 with a sealer 430 in the unsealed position, and no docking apparatus in the vicinity. FIG. 4B illustrates a portion of the zone isolation assembly 414 with the sealer 430 in the sealed position, and no docking apparatus in the vicinity. FIG. 4C illustrates the zone isolation assembly 414 with the sealer 430 in the sealed position, and a docking apparatus 434 in the vicinity but in the undocked position. FIG. 4D illustrates the zone isolation assembly 414 with the sealer 430 in the sealed position, and the docking apparatus 434 in the docked position with the docking receiver 432. In FIG. 4D, a first fluid 425F is ready for purging from a first zone 422 up to the surface.

In this embodiment, the zone isolation assembly 414 includes a filling material 458 that is positioned within the fluid receiving pipe 428 to reduce a fluid volume of the first fluid 425F within the first zone 422. Additionally, the fluid receiving pipe 428 can have a pipe diameter 360 (illustrated in FIG. 3A) that varies, as previously described. Alternatively, the pipe diameter 360 can be substantially consistent along the length 16L (illustrated in FIG. 1B) of the fluid receiving pipe 428. However, in this embodiment, the zone isolation assembly 414 also includes a fluid collector 462 that collects the first fluid 425F from the first zone 422 for transport of the first fluid 425F toward the surface (see FIG. 4D) once the first fluid 425F has moved through the fluid inlet structure 438.

The design of the fluid collector 462 can vary depending upon the requirements of the fluid monitoring system 410. In the embodiment illustrated in FIGS. 4A-D, the fluid collector 462 is secured to the docking receiver 432 and extends in a downwardly direction into the first zone 422. In the embodiment illustrated in FIGS. 4A-D, the fluid collector 462 is a perforated sipping tube that receives the first fluid 425F from the first zone 422. The sipping tube can collect the first fluid 425F substantially evenly along a portion or all of the fluid inlet structure 438. Alternatively, the fluid collector 462 can be another type of device that collects the first fluid 425F for transport to the docking receiver 432. For example, the fluid collector 462 can include as non-exclusive examples, bladder pumps, electrical pumps, single valve pneumatic lift and gas displacement pumps, dual valve pneumatically actuated hydraulic lift pumps, double piston and single piston pumps, passive diffusion bags, fluid sensor apparatuses, bailers of any type including pressurized bailers, and any other type of grab sampling device such as SNAP samplers, HydroSleeves, etc.

As provided previously, when the sealer 430 is in the sealed position and the docking apparatus 434 is in the engaged position with the docking receiver 432, the first zone 422 is isolated from the second zone 424. Thus, because the fluid collector 462 is positioned within the first zone 422, in the engaged position, the fluid collector 462 only collects the first fluid 425F, as illustrated in FIG. 4D.

The fluid collector 462 has a length 464 that can be varied to suit the design requirements of the first zone 422 and the fluid monitoring system 410. In certain embodiments, the fluid collector 462 can extend substantially from the docking receiver 432 to the end cap 440. Alternatively, the length 464 of the fluid collector 462 may not extend the entire distance to the end cap 440.

Figures 5A, 5B, 5C, 5D, 5E:
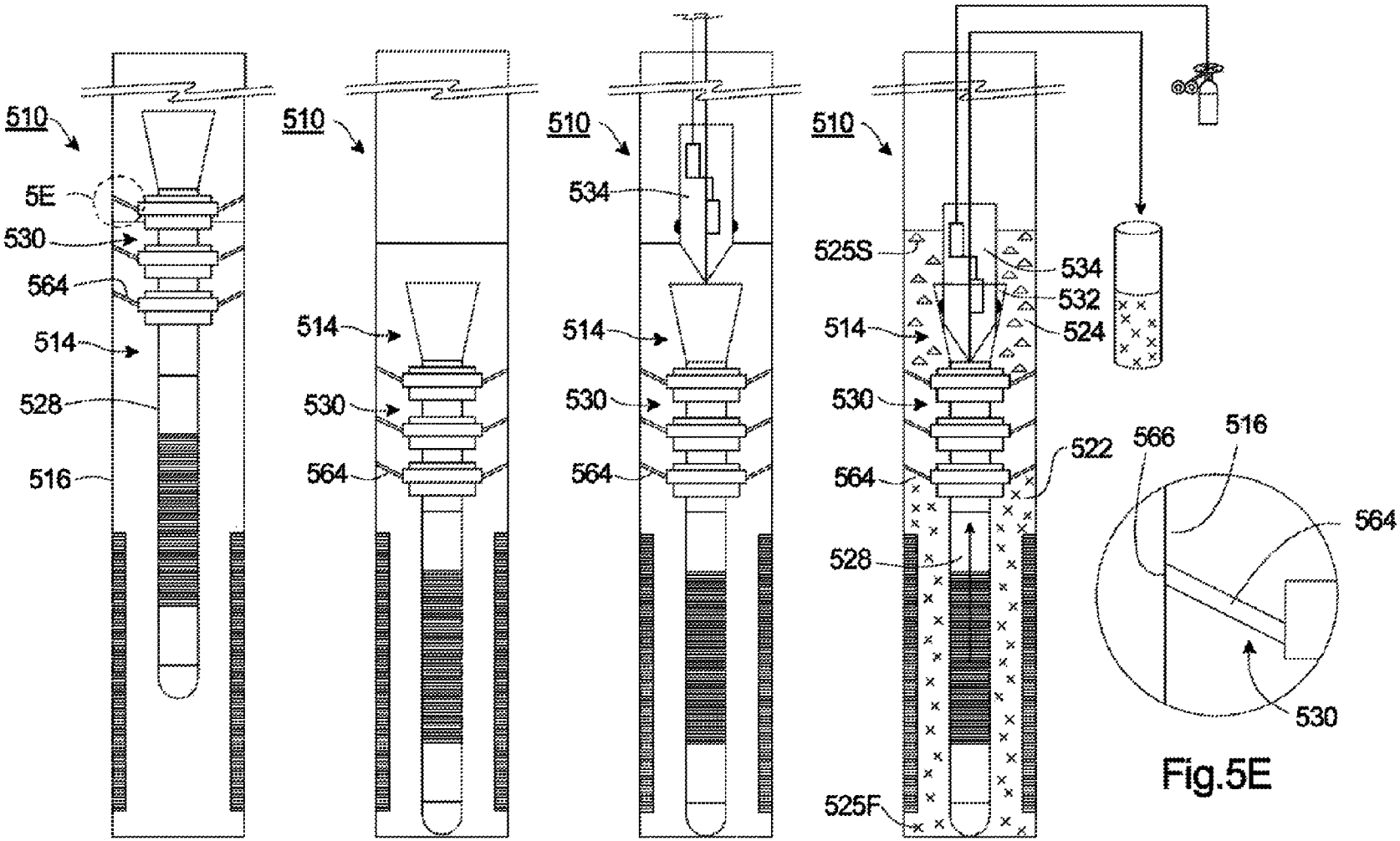
FIGS. 5A-D illustrate schematic views of various stages of installation of another embodiment of the fluid monitoring system.

FIGS. 5A-D illustrate schematic views of various stages of installation of another embodiment of the fluid monitoring system 510. FIG. 5A illustrates a portion of a zone isolation assembly 514 in a non-collection position as the zone isolation assembly 514 is moving downward within the casing 516. FIG. 5B illustrates a portion of the zone isolation assembly 514 in a collection position, with no docking apparatus in the vicinity. FIG. 5C illustrates the zone isolation assembly 514 with the sealer 530 in the collection position, and a docking apparatus 534 in the vicinity but in the undocked position. FIG. 5D illustrates the zone isolation assembly 514 with the sealer 530 in the collection position, and the docking apparatus 534 in the docked position with the docking receiver 532. In FIG. 5D, a first fluid 525F is ready for purging from a first zone 522 up to the surface.

In this embodiment, the sealer 530 includes one or more flexible flanges 564 (three flanges are illustrated in each of FIGS. 5A-D) that provide repeatable seals between the fluid receiving pipe 528 and the casing 516. The flanges 564 are substantially circular in shape and encircle the fluid receiving pipe 528 and/or the docking receiver 532. The flanges 564 form one or more seals to isolate the first zone 522 from the second zone 524, and thus inhibit fluid communication between the first fluid 525F and the second fluid 525S when the docking apparatus 534 is in the docked position. Although three flanges 564 are illustrated in FIGS. 5A-D, any suitable number of flanges 564 could be included in the zone isolation assemblies 514 provided herein. Alternatively, the sealer 530 can include gaskets of various thicknesses or other suitable flange-type devices that can form one or more seals between the fluid receiving pipe 528 and the casing 516.

FIG. 5E is a detailed cross-sectional view of the portion of the sealer 530 illustrated in the dashed circle (identified as 5E) in FIG. 5A and a portion of the casing 516. In one embodiment, each flange 564 includes an angled contact region 566 that contacts the casing 516 both during deployment of the zone isolation assembly 514 (illustrated in FIG. 5D) and while the zone isolation assembly 514 is in the collection position. The contact region 566 can have an angle that allows the contact region 566 to remain substantially flush with the casing 516 during deployment and while in the collection position.

In the embodiment illustrated in FIG. 5A-E, the flanges 564 are slanted in somewhat of an upward direction moving from the fluid receiving pipe 528 toward the contact region 566. With this design, the sealer 530 can better maintain the positioning of the zone isolation assembly 514 even if fluid is exerting an upward force on the flanges 564. Additionally, the somewhat upward angle of the flanges 564 allow easier deployment of the zone isolation assembly 514 downward into the casing 516 and into the collection position.

Figures 6A, 6B, 6C, 6D:
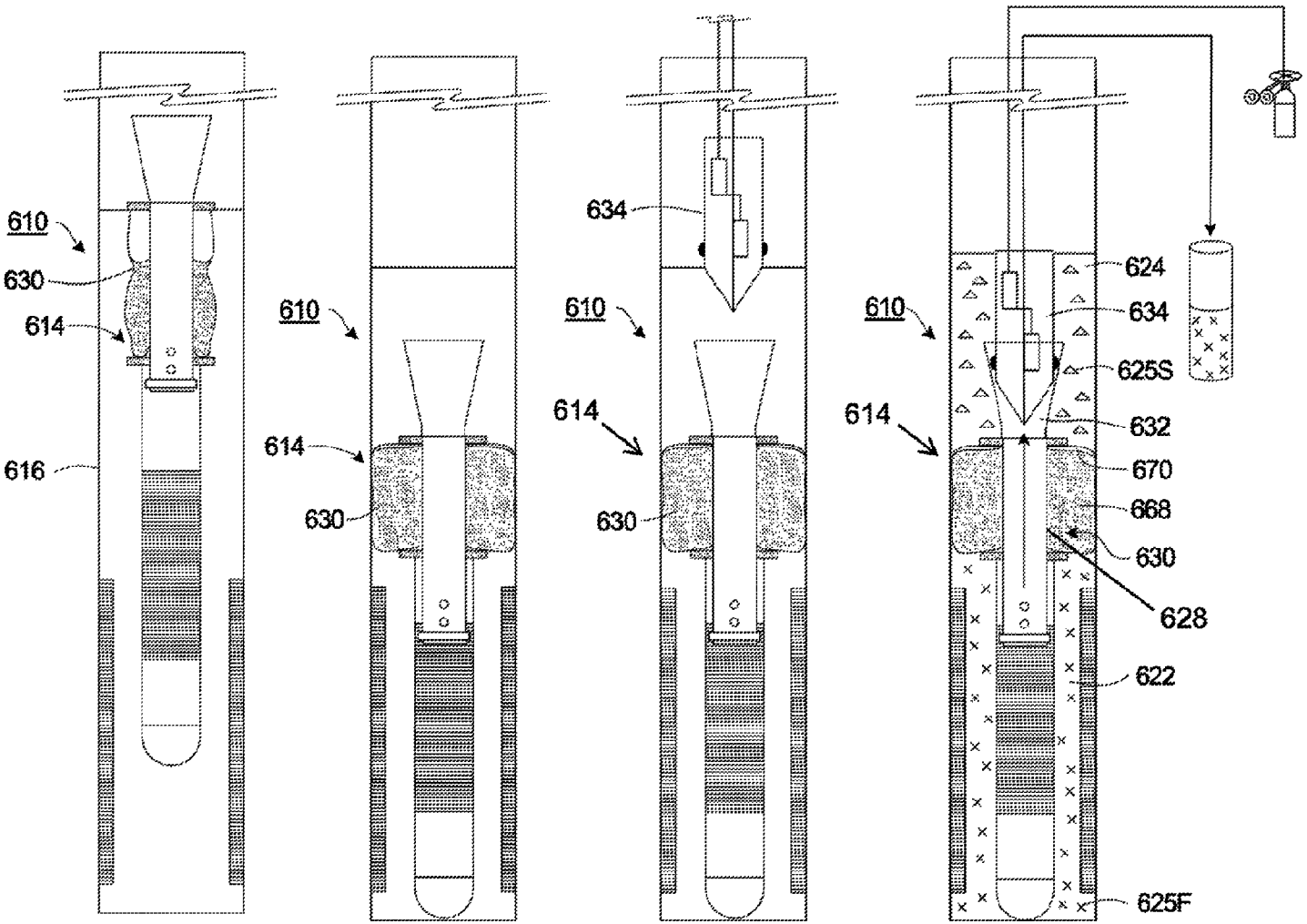
FIGS. 6A-D illustrate schematic views of various stages of installation of yet another embodiment of the fluid monitoring system.

FIGS. 6A-D illustrate schematic views of various stages of installation of another embodiment of the fluid monitoring system 610. FIG. 6A illustrates a portion of a zone isolation assembly 614 in a non-collection position as the zone isolation assembly 614 is being deployed downward within the casing 616. FIG. 6B illustrates a portion of the zone isolation assembly 614 in a collection position, with no docking apparatus in the vicinity. FIG. 6C illustrates the zone isolation assembly 614 with the sealer 630 in the collection position, and a docking apparatus 634 in the vicinity but in the undocked position. FIG. 6D illustrates the zone isolation assembly 614 with the sealer 630 in the collection position, and the docking apparatus 634 in the docked position with the docking receiver 632. In FIG. 6D, a first fluid 625F is ready for purging from a first zone 622 up to the surface.

In the embodiment illustrated in FIGS. 6A-D, the sealer 630 includes a collapsing packer bag 668 that seals off the first zone 622 from the second zone 624 when the docking apparatus 634 is in the docked position. In one embodiment, the packer bag is filled with deionized water (not shown) or another suitable fluid. Further, the packer bag 668 can include an outer membrane 670 that is strong enough to withstand compressive strain when the packer bag 668 is compressed to form the seal between the fluid receiving pipe 628 and the casing 616. In the position illustrated in FIG. 6D, the second fluid 625S is isolated from the first fluid 625F.

Figure 7D:
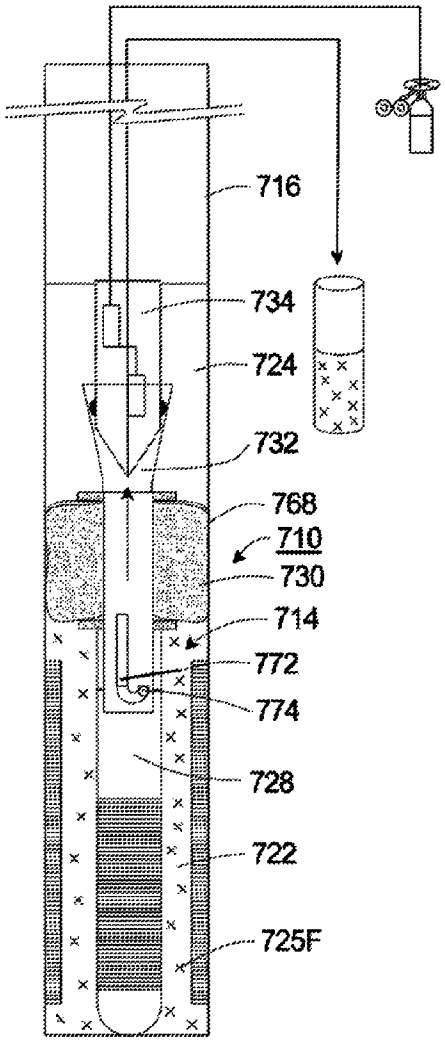
FIGS. 7A-D illustrate schematic views of various stages of installation of still another embodiment of the fluid monitoring system.
Figure 7C:
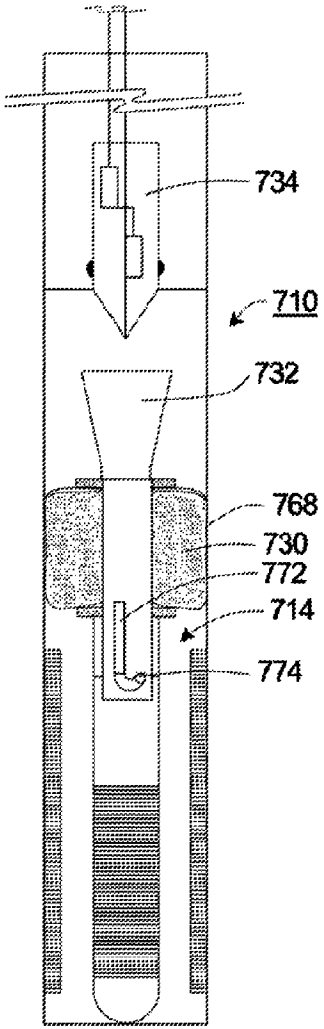
Figure 7B:
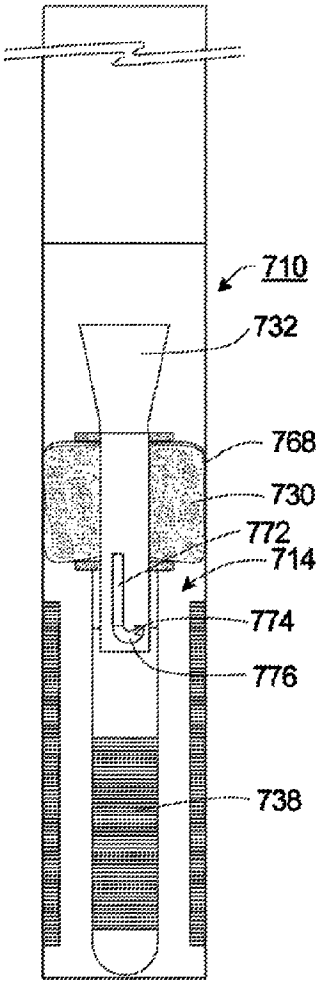
Figure 7A:
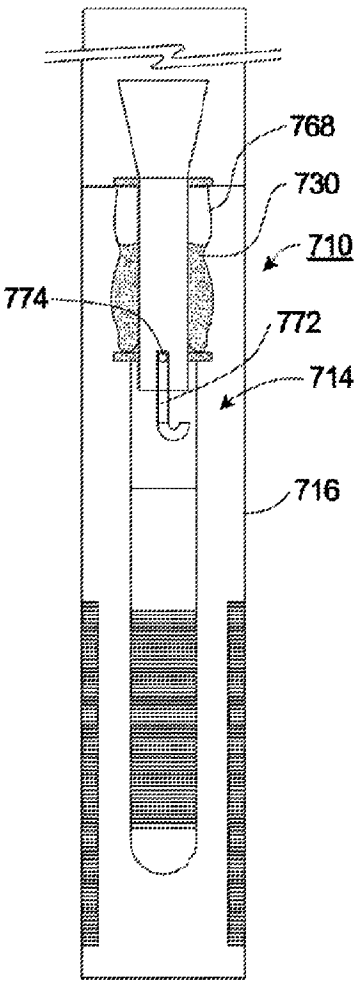

FIGS. 7A-D illustrate schematic views of various stages of installation of still another embodiment of the fluid monitoring system 710. FIG. 7A illustrates a sealer 730 of a zone isolation assembly 714 in a non-collection position as the zone isolation assembly 714 is being deployed downward within the casing 716. FIG. 7B illustrates the sealer 730 in a collection position, with no docking apparatus in the vicinity. FIG. 7C illustrates the zone isolation assembly 714 with the sealer 730 in the collection position, and a docking apparatus 734 in the vicinity but in the undocked position. FIG. 7D illustrates the zone isolation assembly 714 with the sealer 730 in the collection position, and the docking apparatus 734 in the docked position with the docking receiver 732. In FIG. 7D, a first fluid 725F is ready for purging from a first zone 722 up to the surface.

In the embodiment illustrated in FIGS. 7A-D, the sealer 730 includes a collapsing packer bag 768 that seals off the first zone 722 from the second zone 724 when the docking apparatus 734 is in the docked position. The bag 768 can be compressed by applying mechanical pressure to form a seal around the fluid receiving pipe 728 below the docking receiver 732, and against the casing 716.

In this embodiment, the zone isolation assembly includes a J-slot 772 that is coupled to the sealer 730. The sealer 730 can be uncompressed as illustrated in FIG. 7A. Upon compression of the bag, a pin 774 in the J-slot 772 descends to its lowest point as illustrated in FIG. 7B. The operator can then release pressure, and the pin 774 can rise to engage a second upward leg 776 of the J-slot 772. The sealer 730 is compressed to seal the fluid inlet structure 738 from the area above the docking receiver 732. The resistance of the compressed bag sealed against the casing will keep the pin 774 engaged in a locked position, as illustrated in FIGS. 7B-D.

Figures 8A, 8B, 8C, 8D:
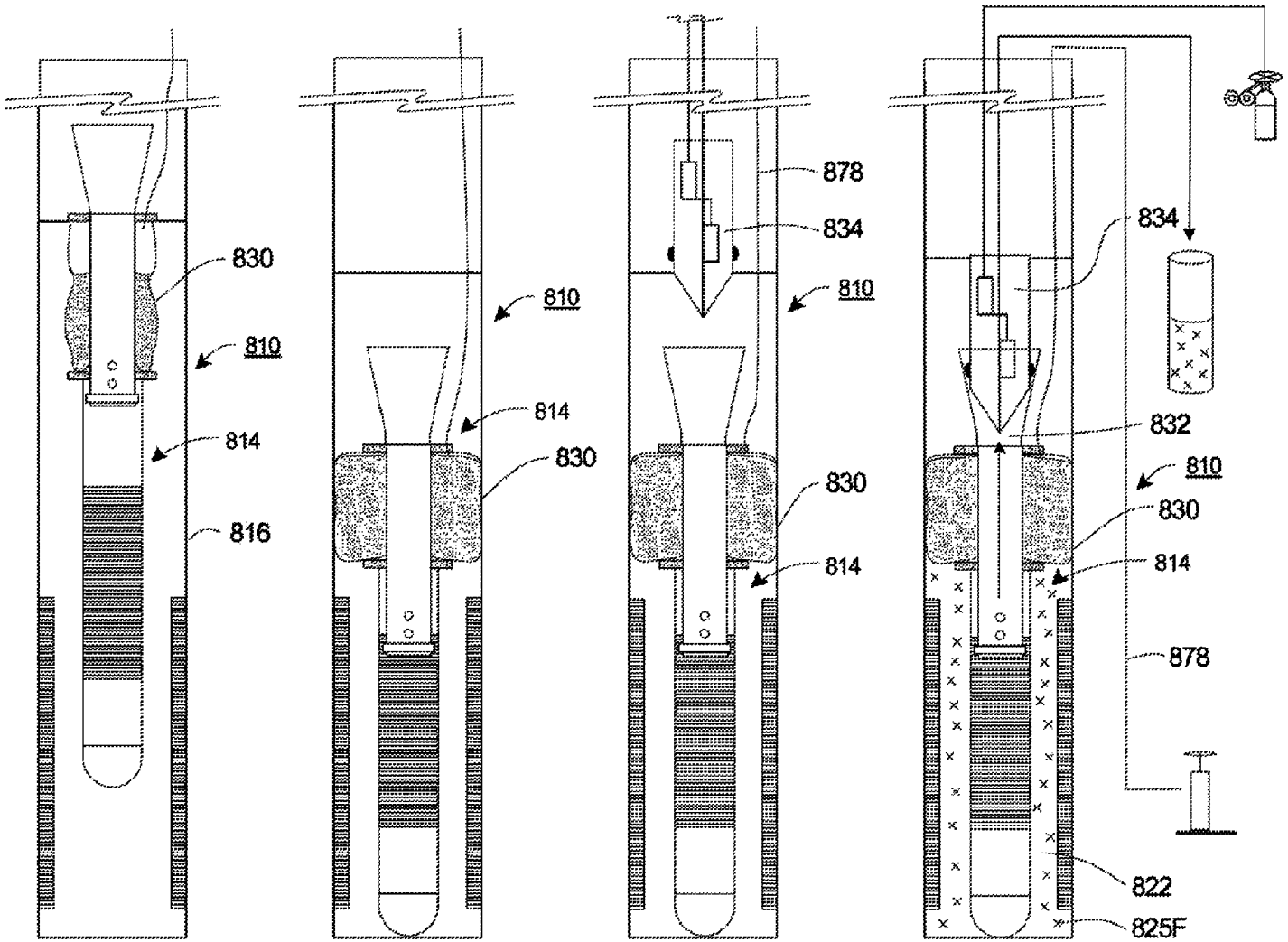
FIGS. 8A-D illustrate schematic views of various stages of installation of another embodiment of the fluid monitoring system.

FIGS. 8A-D illustrate schematic views of various stages of installation of yet another embodiment of the fluid monitoring system 810. FIG. 8A illustrates a sealer 830 in a non-collection position as the zone isolation assembly 814 is being deployed downward within the casing 816. FIG. 8B illustrates the sealer 830 in a collection position, with no docking apparatus in the vicinity. FIG. 8C illustrates the zone isolation assembly 814 with the sealer 830 in the collection position, and a docking apparatus 834 in the vicinity but in the undocked position. FIG. 8D illustrates the zone isolation assembly 814 with the sealer 830 in the collection position, and the docking apparatus 834 in the docked position with the docking receiver 832. In FIG. 8D, a first fluid 825F is ready for purging from a first zone 822 up to the surface.

In this embodiment, the sealer 830 can be inflated by means of pressure applied through tubing 878 extending from the ground surface, through a pass-through in the docking receiver 832, to the sealer 830.

Figures 9A, 9B, 9C, 9D:
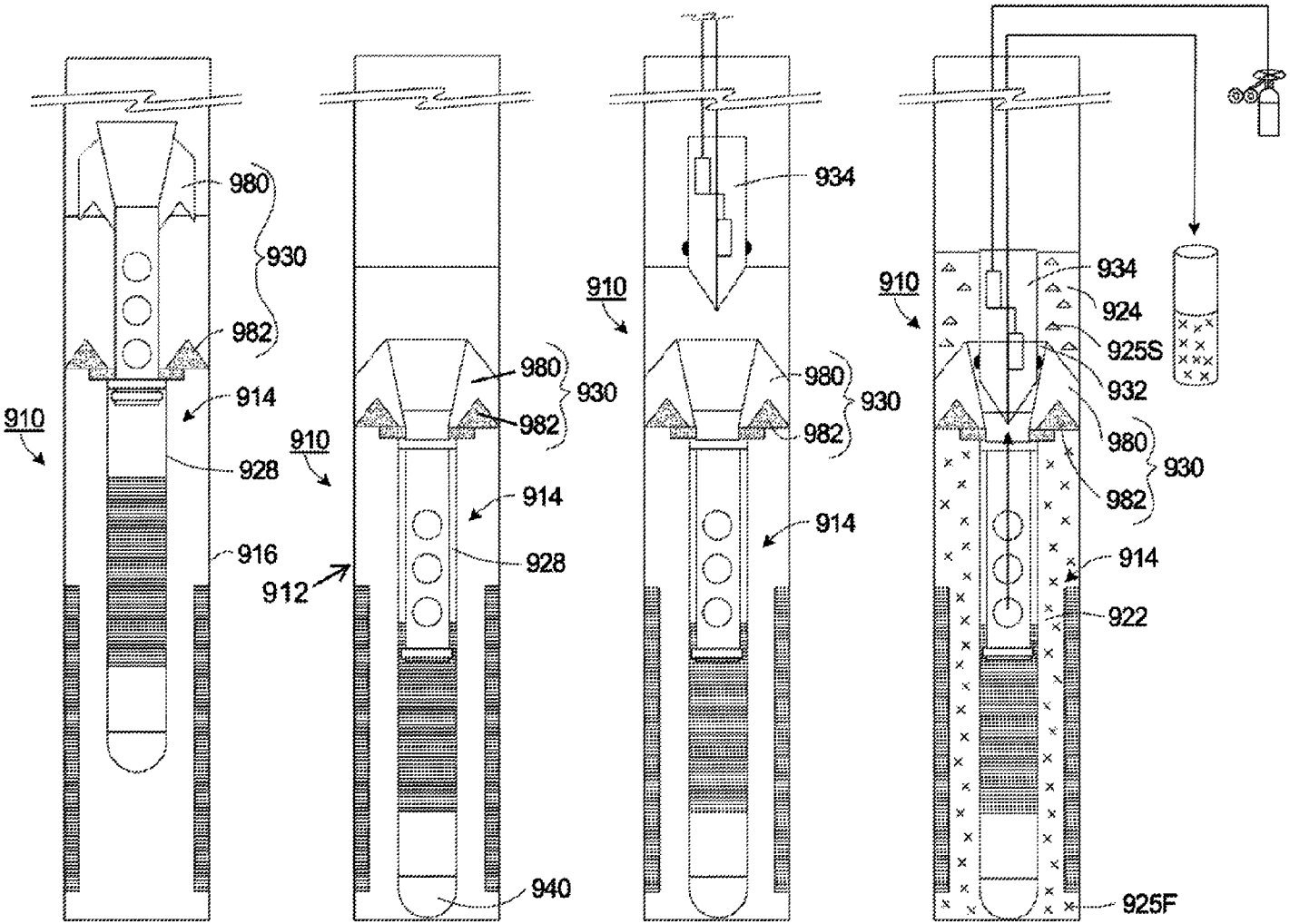
FIGS. 9A-D illustrate schematic views of various stages of installation of yet another embodiment of the fluid monitoring system.

FIGS. 9A-D illustrate schematic views of various stages of installation of another embodiment of the fluid monitoring system 910. FIG. 9A illustrates a portion of a zone isolation assembly 914 in a non-collection position as the zone isolation assembly 914 is moving downward within the casing 916. FIG. 9B illustrates a portion of the zone isolation assembly 914 in a collection position, with no docking apparatus in the vicinity. FIG. 9C illustrates the zone isolation assembly 914 with the sealer 930 in the collection position, and a docking apparatus 934 in the vicinity but in the undocked position. FIG. 9D illustrates the zone isolation assembly 914 with the sealer 930 in the collection position, and the docking apparatus 934 in the docked position with the docking receiver 932. In FIG. 9D, a first fluid 925F is ready for purging from a first zone 922 up to the surface.

In this embodiment, the zone isolation assembly 914 can include a telescoping fluid receiving pipe 928 that is secured to the docking receiver 932. The zone isolation assembly 914 can also include, or in the alternative, a sealer 930 including an upper section 980 and a lower section 982. In one embodiment, the zone isolation assembly 914 is deployed into the casing 916. The telescoping fluid receiving pipe 928 is fully extended (illustrated in FIG. 9A) while being lowered down into the casing 916. In the fully extended position, the upper section 980 and the lower section 982 are spaced apart from one another. Once the end cap 940 contacts the bottom of the well 912, the telescoping fluid receiving pipe 928 collapses under its own weight until the upper section 980 engages and forms a seal with the lower section 982. Once this seal is formed and the docking apparatus 934 is in the docked position, the first fluid 925F in the first zone 922 is isolated from the second fluid 925S in the second zone 924 as illustrated in FIG. 9D.

In one embodiment, the upper section 980 can include a resilient material such as rubber, plastic or another suitable material. The lower section 982 can include a more rigid material, such as metal, ceramic or another suitable material. Alternatively, the materials of the upper section 980 and the lower section 982 can be reversed. Still alternatively, the materials used to form the upper section 980 and the lower section 982 can include any suitable materials that form an appropriate seal. In various embodiments, the shapes of the upper section 980 and the lower section 982 can be complementary to one another to enhance the sealing characteristics of the sealer 930.

Figures 10A, 10B, 10C, 10D:
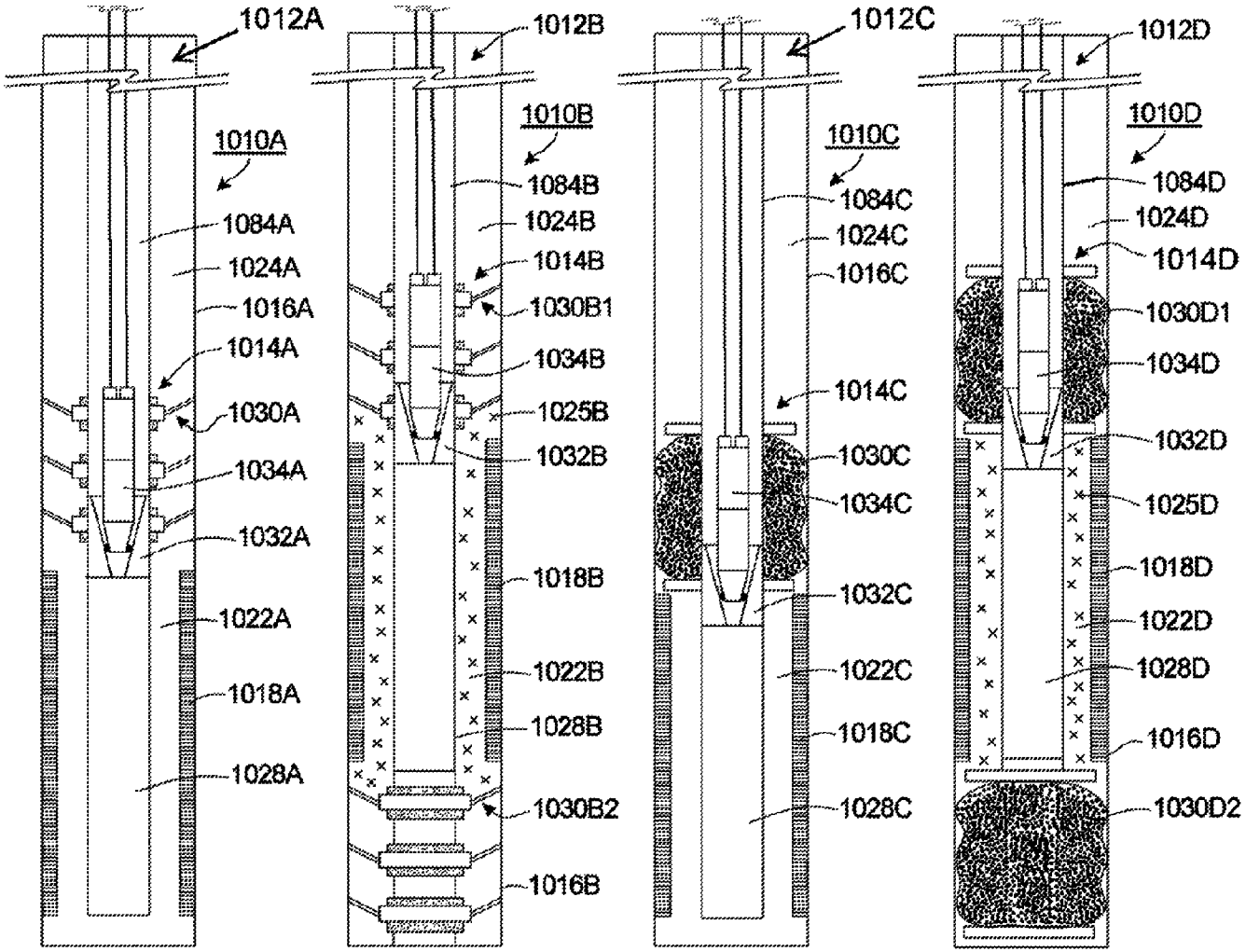
FIG. 10A illustrates a schematic view of another embodiment of the fluid monitoring system including the zone isolation assembly.
FIG. 10B illustrates a schematic view of yet another embodiment of the fluid monitoring system including the zone isolation assembly.
FIG. 10C illustrates a schematic view of still another embodiment of the fluid monitoring system including the zone isolation assembly.
FIG. 10D illustrates a schematic view of another embodiment of the fluid monitoring system including the zone isolation assembly.

FIG. 10A illustrates a schematic view of an existing well 1012A and another embodiment of the fluid monitoring system 1010A including the zone isolation assembly 1014A. In this embodiment, the zone isolation assembly 1014A includes the fluid receiving pipe 1028A, the sealer 1030A, the docking receiver 1032A and the docking apparatus 1034A. In this embodiment, the zone isolation assembly 1014A also includes an inner riser pipe 1084A that extends upward toward the surface from the docking receiver 1032A. In the embodiment illustrated in FIG. 10A, the zone isolation assembly 1014A is deployed from the surface until the fluid receiving pipe 1028A is appropriately positioned relative to the fluid intake device 1018A of the casing 1016A. In this embodiment, once the sealer 1030A forms a seal between the riser pipe 1084A and the casing 1016A, and the docking apparatus 1034A is in the docked position, the first zone 1022A is isolated from the second zone 1024A.

FIG. 10B illustrates a schematic view of yet another embodiment of the fluid monitoring system 1010B including the zone isolation assembly 1014B. In this embodiment, the zone isolation assembly 1014B includes the fluid receiving pipe 1028B, a first sealer 1030B1, a second sealer 1030B2, the docking receiver 1032B and the docking apparatus 1034B. In this embodiment, the zone isolation assembly 1014B also includes the inner riser pipe 1084B that extends upward toward the surface from the docking receiver 1032B. In the embodiment illustrated in FIG. 10B, the zone isolation assembly 1014B is deployed from the surface until the fluid receiving pipe 1028B is appropriately positioned relative to the fluid intake device 1018B of the casing 1016B. In this embodiment, once the sealers 1030B1, 1030B2 form seals so that the fluid intake device 1018B is positioned substantially between the sealers 1030B1, 1030B2, and the docking apparatus 1034B is in the docked position, the first zone 1022B is isolated from the second zone 1024B. With this design, the fluid purge volume can be reduced because only the fluid 1025B adjacent to the fluid intake device 1018B needs to be purged, rather than any fluid in the existing well 1012B below the fluid intake device 1018B.

FIG. 10C illustrates a schematic view of an existing well 1012C and another embodiment of the fluid monitoring system 1010C including the zone isolation assembly 1014C. In this embodiment, the zone isolation assembly 1014C includes the fluid receiving pipe 1028C, the sealer 1030C, the docking receiver 1032C and the docking apparatus 1034C. In one embodiment, the sealer 1030C can include a time-release bentonite pellet bag. Alternatively, any other suitable type of sealer 1030C can be used. In this embodiment, the zone isolation assembly 1014C includes the inner riser pipe 1084C that extends upward toward the surface from the docking receiver 1032C. In the embodiment illustrated in FIG. 10C, the zone isolation assembly 1014C is deployed from the surface until the fluid receiving pipe 1028C is appropriately positioned relative to the fluid intake device 1018C of the casing 1016C. In this embodiment, once the sealer 1030C forms a seal between the riser pipe 1084C and the casing 1016C, and the docking apparatus 1034C is in the docked position, the first zone 1022C is isolated from the second zone 1024C.

FIG. 10D illustrates a schematic view of yet another embodiment of the fluid monitoring system 1010D including the zone isolation assembly 1014D. In this embodiment, the zone isolation assembly 1014D includes the fluid receiving pipe 1028D, a first sealer 1030D1, a second sealer 1030D2, the docking receiver 1032D and the docking apparatus 1034D. In one embodiment, one or more of the sealers 1030D1, 1030D2 can include a time-release bentonite pellet bag. Alternatively, any other suitable type of sealer 1030D1, 1030D2 can be used. In this embodiment, the zone isolation assembly 1014D also includes the inner riser pipe 1084D that extends upward toward the surface from the docking receiver 1032D. In the embodiment illustrated in FIG. 10D, the zone isolation assembly 1014D is deployed from the surface until the fluid receiving pipe 1028D is appropriately positioned relative to the fluid intake device 1018D of the casing 1016D. In this embodiment, once the sealers 1030D1, 1030D2 form seals so that the fluid intake device 1018D is positioned substantially between the sealers 1030D1, 1030D2, and the docking apparatus 1034D is in the docked position, the first zone 1022D is isolated from the second zone 1024D. With this design, the fluid purge volume can be reduced because only the fluid 1025D adjacent to the fluid intake device 1018D needs to be purged, rather than any fluid in the existing well 1012D below the fluid intake device 1018D.

Figures 11A, 11B, 11C, 11D:
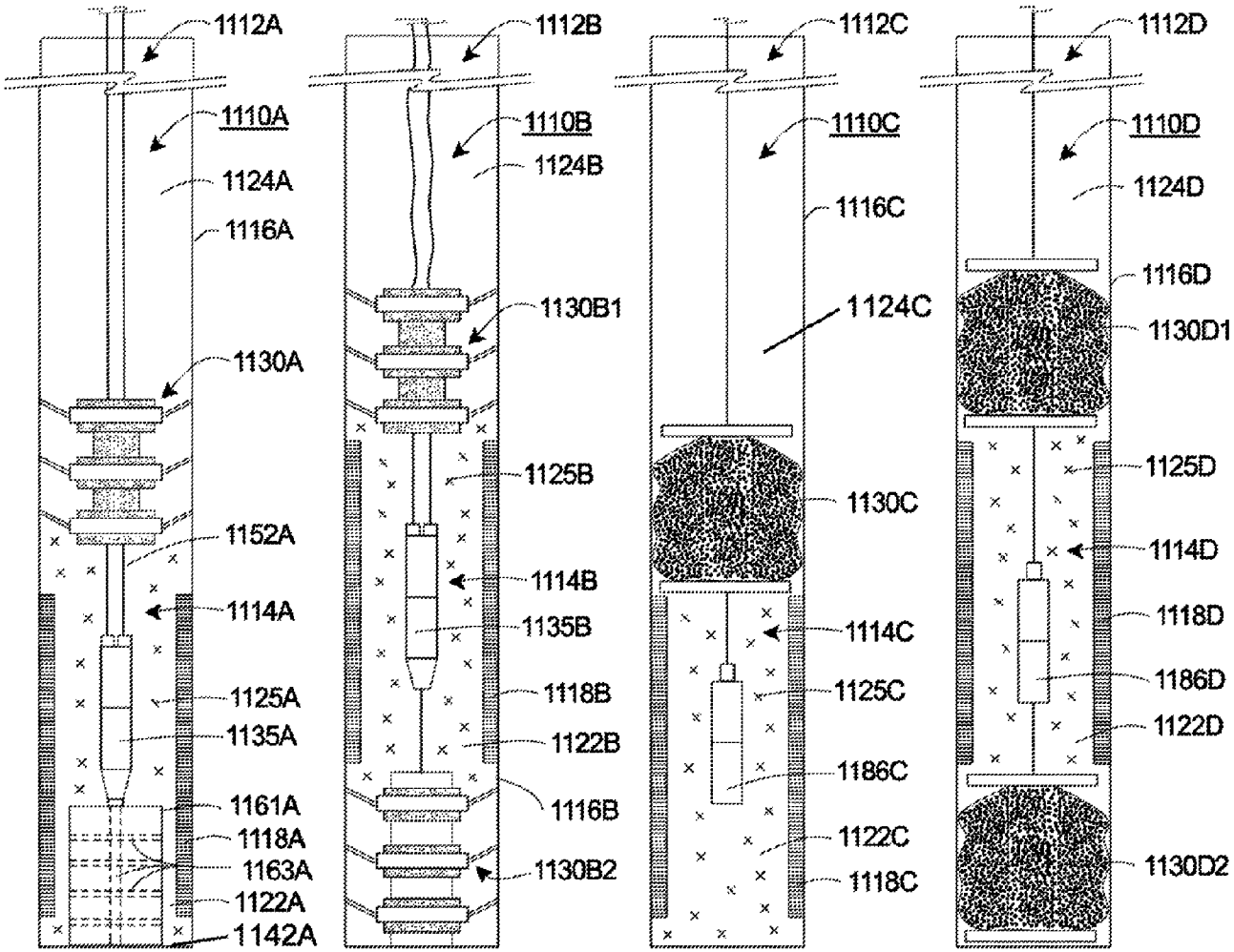
FIG. 11A illustrates a schematic view of another embodiment of the fluid monitoring system including the zone isolation assembly.
FIG. 11B illustrates a schematic view of yet another embodiment of the fluid monitoring system including the zone isolation assembly.
FIG. 11C illustrates a schematic view of still another embodiment of the fluid monitoring system including the zone isolation assembly.
FIG. 11D illustrates a schematic view of another embodiment of the fluid monitoring system including the zone isolation assembly.

FIG. 11A illustrates a schematic view of an existing well 1112A and another embodiment of the fluid monitoring system 1110A including the zone isolation assembly 1114A. In this embodiment, the zone isolation assembly 1114A includes the sealer 1130A, a pump assembly 1135A and a volume displacer 1161A. The pump assembly 1135A is coupled to the sealer 1130A. The volume displacer 1161A can be removably (i.e. threadedly or by other suitable means) or permanently secured to the pump assembly 1135A.

In certain embodiments, the pump assembly 1135A and the volume displacer 1161A can be suspended from the sealer 1130A. In the embodiment illustrated in FIG. 11A, the fluid receiving pipe, the docking receiver and the docking apparatus have been omitted. In the embodiment illustrated in FIG. 11A, the zone isolation assembly 1114A is deployed from the surface until the pump assembly 1135A is appropriately positioned relative to the fluid intake device 1118A of the casing 1116A.

In this embodiment, once the sealer 1130A forms a seal with the casing 1116A, the first zone 1122A is isolated from the second zone 1124A. The pump assembly 1135A can then pump the fluid 1125A that enters the pump assembly 1135A to a sample receiver 50 (illustrated in FIG. 1D) via the sample outlet line 1152A.

The volume displacer 1161A displaces a volume of first fluid 1125A within the fluid zone 20 (illustrated in FIGS. 1A and 1D). The volume of first fluid 1125A that is displaced by the volume displacer 1161A can vary depending upon the diameter of the casing 1116A and the volume of the volume displacer 1161A. Once the sealer 1130A forms a seal with the casing 1116A, the volume displacer 1161A reduces the volume of first fluid 1125A that needs to be purged from the first zone 1122A prior to or during fluid sampling.

The materials used to form the volume displacer 1161A can vary. In one embodiment, the volume displacer 1161A is formed from a rigid plastic material. Alternatively, the volume displacer 1161A can be formed from metal, ceramic, various composites, or any other suitably rigid and relatively dense materials. In one embodiment, the volume displacer 1161A can rest on the well bottom 1142A. With this design, the volume displacer 1161A can act as a support structure to at least partially support the weight of the pump assembly 1135A and the sealer 1130A in the well 1112A. Additionally, or in the alternative, the volume displacer 1161A can include a fluid filter (not shown) that filters the first fluid 1125A that moves through the volume displacer 1161A into the pump assembly 1135A. The volume displacer 1161A can include one or more channels 1163A that receive the first fluid 1125A and provide avenues for the first fluid 1125A to move upwards into the pump assembly 1135A.

Additionally, in another embodiment, the volume displacer 1161A can be temporarily removed or entirely omitted so that the zone isolation assembly 1114A includes the sealer 1130A and the pump assembly 1135A.

FIG. 11B illustrates a schematic view of yet another embodiment of the fluid monitoring system 1110B including the zone isolation assembly 1114B. In this embodiment, the zone isolation assembly includes a first sealer 1130B1, a second sealer 1130B2 and a pump assembly 1135B. In the embodiment illustrated in FIG. 11B, the fluid receiving pipe, the docking receiver and the docking apparatus have been omitted. In the embodiment illustrated in FIG. 11B, the zone isolation assembly 1114B is deployed from the surface until the pump assembly 1135B is appropriately positioned relative to the fluid intake device 1118B of the casing 1116B. In this embodiment, once the sealers 1130B1, 1130B2 form seals so that the fluid intake device 1118B is positioned substantially between the sealers 1130B1, 1130B2, the first zone 1122B is isolated from the second zone 1124B. With this design, the fluid purge volume can be reduced because only the fluid 1125B adjacent to the fluid intake device 1118B needs to be purged, rather than any fluid in the existing well 1112B below the fluid intake device 1118B.

FIG. 11C illustrates a schematic view of an existing well 1112C and another embodiment of the fluid monitoring system 1110C including the zone isolation assembly 1114C. In this embodiment, the zone isolation assembly includes the sealer 1130C and a sensor apparatus 1186C (also sometimes referred to herein simply as a "sensor"). In the embodiment illustrated in FIG. 11C, the fluid receiving pipe, the docking receiver and the docking apparatus have been omitted. In one non-exclusive embodiment, the sealer 1130C can include a time-release bentonite pellet bag or bentonite sock packer. Alternatively, any other suitable type of sealer 1130C can be used. In the embodiment illustrated in FIG. 11C, the zone isolation assembly 1114C is deployed from the surface until the sensor apparatus 1186C is appropriately positioned relative to the fluid intake device 1118C of the casing 1116C. In this embodiment, once the sealer 1130C forms a seal with the casing 1116C, the first zone 1122C is isolated from the second zone 1124C and various measurements of the fluid 1125C can be monitored. In various embodiments, the sensor apparatus 1186C can take measurements of fluid pressure, temperature, composition, pH, etc., or any other desired measurements.

FIG. 11D illustrates a schematic view of yet another embodiment of the fluid monitoring system 1110D including the zone isolation assembly 1114D. In this embodiment, the zone isolation assembly includes a first sealer 1130D1, a second sealer 1130D2 and the sensor apparatus 1186D. In the embodiment illustrated in FIG. 11D, the fluid receiving pipe, the docking receiver and the docking apparatus have been omitted. In one embodiment, one or more of the sealers 1130D1, 1130D2 can include a time-release bentonite pellet bag. Alternatively, any other suitable type of sealer 1130D1, 1130D2 can be used. In the embodiment illustrated in FIG. 11D, the zone isolation assembly 1114D is deployed from the surface until the sensor apparatus 1186D is appropriately positioned relative to the fluid intake device 1118D of the casing 1116D. In this embodiment, once the sealers 1130D1, 1130D2 form seals so that the fluid intake device 1118D is positioned substantially between the sealers 1130D1, 1130D2, the first zone 1122D is isolated from the second zone 1124D. With this design, the fluid purge volume can be reduced because only the fluid 1125D adjacent to the fluid intake device 1118D needs to be purged, rather than any fluid in the existing well 1112D below the fluid intake device 1118D.

Figure 12D:
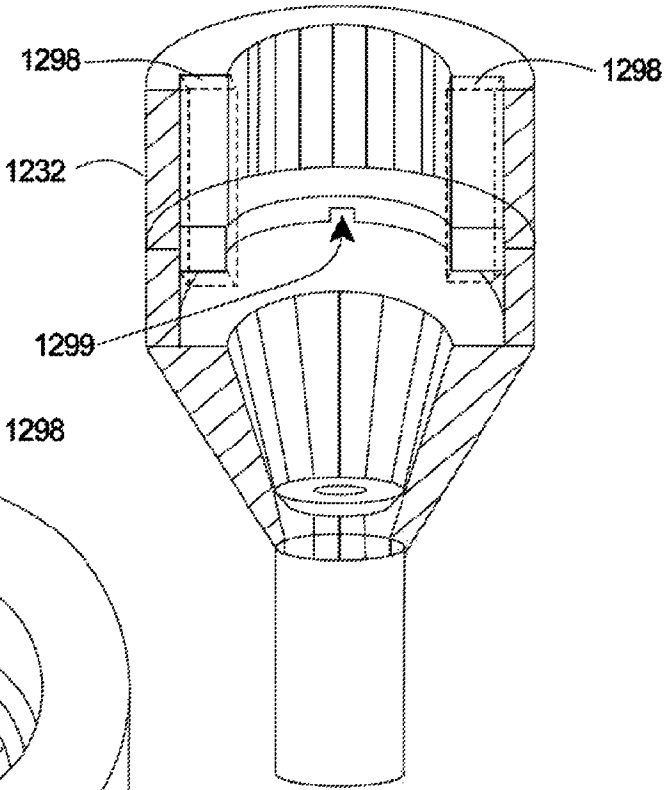
FIGS. 12C-D illustrate perspective views of one embodiment of a docking receiver of the zone isolation assembly.
Figure 12C:
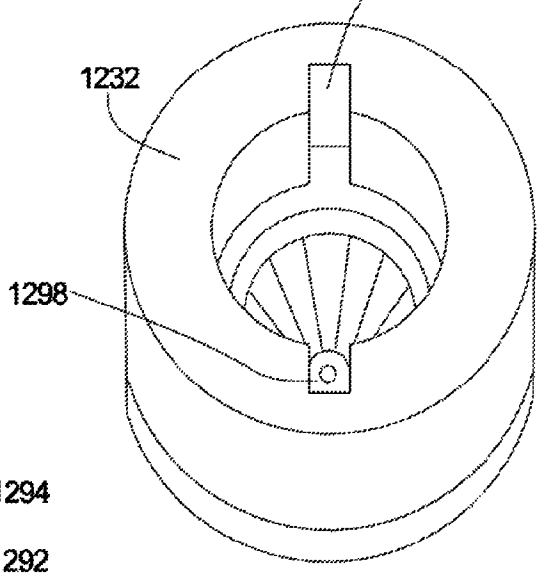
Figure 12B:
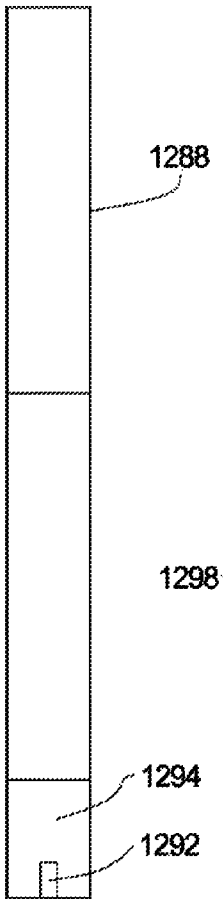
FIGS. 12A-B illustrate side views of one embodiment of a deployment device of the zone isolation assembly.
Figure 12A:
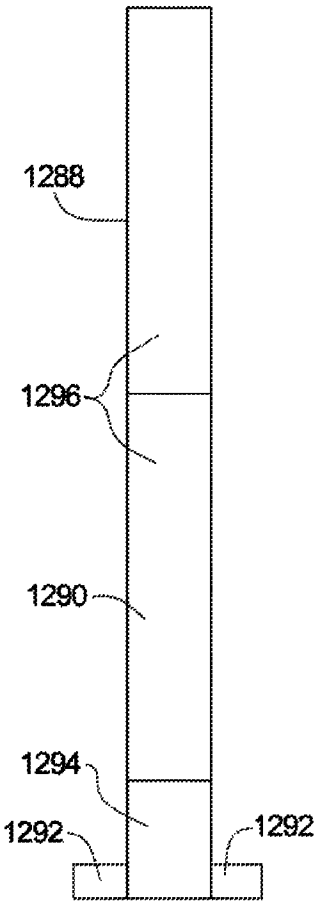

FIG. 12A is a side view of a deployment device 1288 that is used to deploy at least a portion of some of the zone isolation assemblies described herein. For example, the deployment device 1288 can deploy the fluid receiving pipe 28, the sealer 30 and the docking receiver 32 in many of the embodiments illustrated and described herein. The design of the deployment device 1288 can vary depending upon the design requirements of the zone isolation assembly 14 and/or the fluid monitoring system 10. In the embodiment illustrated in FIG. 12A, the deployment device 1288 can include a shaft 1290 and one or more engagement pins 1292 (two engagement pins are illustrated in FIG. 12A) that extend away from a bottom end 1294 or near the bottom end 1294 of the shaft 1290. In the embodiment illustrated in FIG. 12A, the engagement pins 1292 are positioned approximately 180 degrees away from one another. However, any one of the engagement pins 1292 can be positioned at any position relative to any of the other engagement pins 1292. Further, any suitable number of engagement pins 1292 can be used with the deployment device 1288.

The shaft 1290 can be formed from one or more shaft segments 1296 that are connected together in a lengthwise manner to provide the desired length necessary for deployment of the zone isolation assembly 14 to the appropriate depth within the well 12 (illustrated in FIG. 1A). Each shaft segment 1296 can be formed from plastic or another suitably rigid, yet somewhat flexible material to allow deployment even in wells 12 that have some deflection or curvature. In one embodiment, the shaft segments 1296 can be threadedly connected to one another. Alternatively, the shaft segments 1296 can be secured to one another in another suitable manner.

The engagement pins 1292 can be formed from a rigid material such as metal, plastic, ceramic, epoxy, or any other suitable material that can be connected to the shaft 1290. In an alternative embodiment, the engagement pins 1292 can be formed integrally with the shaft 1290.

FIG. 12B is a side view of the deployment device 1288 illustrated in FIG. 12A, rotated approximately 90 degrees. In particular, FIG. 12B illustrates the engagement pins 1292 that extend away from the bottom end 1294 rotated approximately 90 degrees relative to their positioning in FIG. 12A.

FIG. 12C is a top perspective view of one embodiment of a docking receiver 1232 that is adapted to be deployed by the deployment device 1288 illustrated in FIGS. 12A-B. The docking receiver 1232 illustrated in FIG. 12C includes two pin receivers 1298 that each receives one of the engagement pins 1292 (illustrated in FIGS. 12A-B). In this embodiment, the pin receivers 1298 are spaced approximately 180 degrees apart and correspond geometrically to the location of the engagement pins 1292.

FIG. 12D is a perspective sectional view of the docking receiver 1232 illustrated in FIG. 12C. In this embodiment, the two pin receivers 1298 are illustrated in phantom. In one embodiment, the pin receivers 1298 are notches or grooves that allow insertion of a portion of the deployment device 1288 (illustrated in FIG. 12A) into the docking receiver 1232. In the embodiment illustrated in FIG. 12D, the docking receiver 1232 includes one or more pin recesses 1299 (one pin recess is illustrated in FIG. 12D) that retain the engagement pins 1292 during deployment to inhibit or prevent the deployment device 1288 from disengaging with the docking receiver 1232 during deployment or retrieval of the docking receiver 1232, as provided in greater detail below. In one embodiment, the pin recesses 1299 are each positioned approximately 90 degrees from one of the pin receivers 1298, although the positioning of the pin recesses 1299 relative to the pin receivers 1298 can vary if desired.

Figure 14:
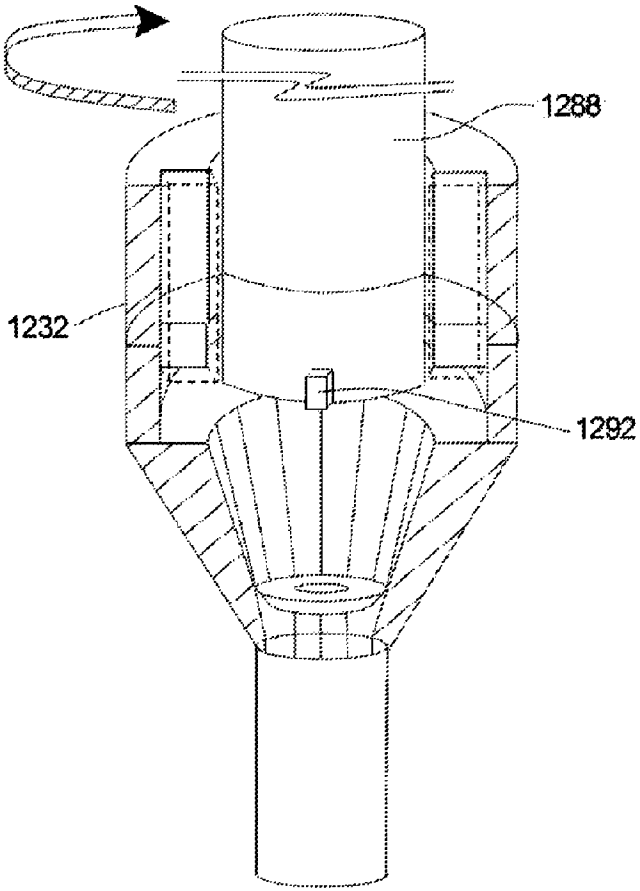
FIG. 14 is a perspective view of the docking receiver illustrated in FIG. 12D and a deployment device for deployment and/or retrieval of the zone isolation assembly.
Figure 13:
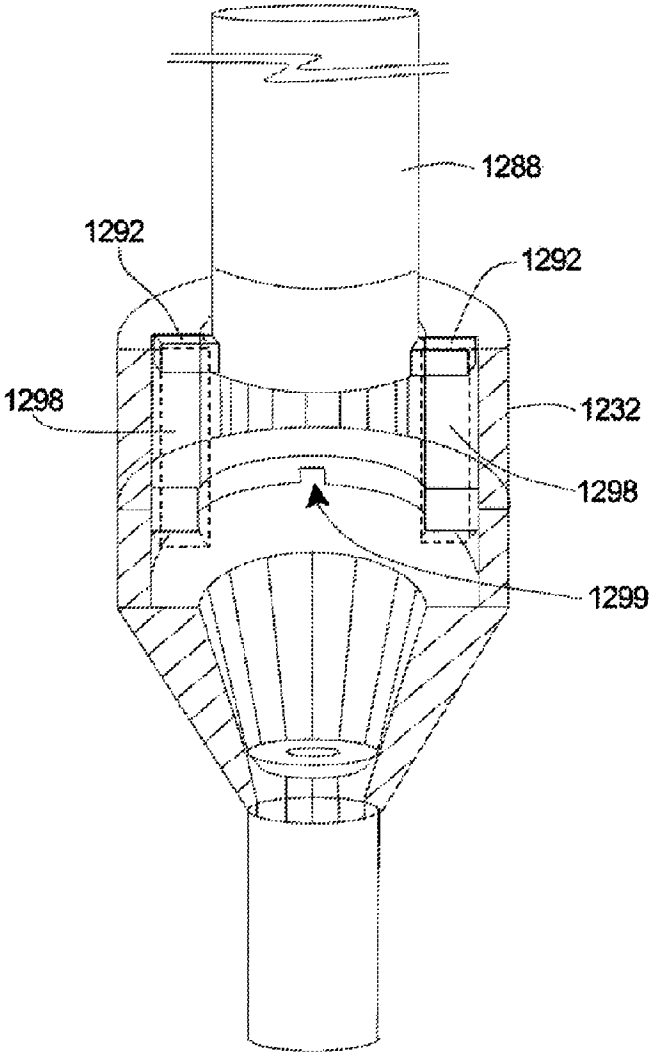
FIG. 13 is a perspective view of the docking receiver illustrated in FIG. 12D and a deployment device for deployment and/or retrieval of the zone isolation assembly.

FIGS. 13 and 14 are perspective sectional views illustrating how the deployment device 1288 in FIGS. 12A-B is lockingly inserted into the docking receiver 1232 (illustrated in FIGS. 12C-D) for deployment and/or retrieval of the zone isolation assembly 14 (or portions thereof).

In FIG. 13, the engagement pins 1292 are initially received by the pin receivers 1298 (illustrated in phantom) by aligning the engagement pins 1292 with the pin receivers 1298 and inserting the deployment device 1288 into the docking receiver 1232.

In FIG. 14, once the deployment device 1288 has been inserted fully into the docking receiver 1232, the deployment device is rotated approximately 90 degrees until the engagement pins 1292 (only one engagement pin 1292 is visible in FIG. 14) are received and retained by the pin recesses 1299 (one pin recess 1299 is illustrated in FIG. 13). In the position illustrated in FIG. 14, the docking receiver 1232, and any structures connected to the docking receiver 1232, can be deployed and/or retrieved by the deployment device 1288. In FIG. 14, the position of the deployment device 1288 is substantially fixed during descent to the drop-off point inside the well 12. Therefore, the docking receiver 1232 is gravitationally seated and suspended onto the engagement pins 1292 of the deployment device 1288 during substantially the entire descent to the target depth.

For retrieving the zone isolation assembly (or portions thereof), the deployment device 1288 is lowered to the top of the docking receiver 1232 and rotated until the engagement pins 1292 drop into the pin receivers 1298. As before, the deployment device 1288 is rotated approximately 90 degrees until the operator physically sees and/or feels the engagement pins 1292 slide upwardly into the pin recesses 1299. By pulling up on the deployment device 1288, the zone isolation assembly 14 can be retrieved to the surface.

To release the deployment device 1288 from the docking receiver 1232, the insertion process is basically reversed. The deployment device 1288 is pushed downward and rotated by approximately 90 degrees to release the engagement pins 1292 from the pin recesses 1299 and align the engagement pins 1292 with the pin receivers 1298. Once aligned, the deployment device 1288 can be removed by an upward (pulling) force on the deployment device 1288 away from the docking receiver 1232.

Figure 15B:
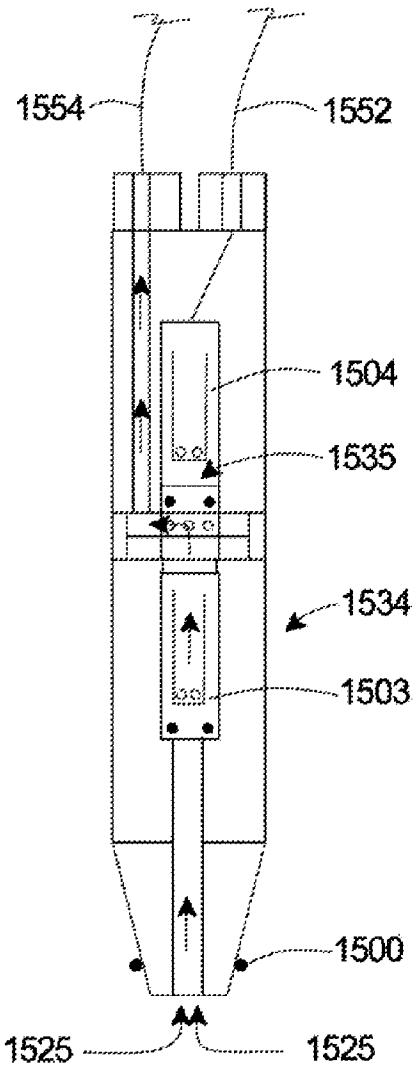
FIGS. 15A-B are schematic views illustrating operation of the docking apparatus and a pump assembly of the zone isolation assembly.
Figure 15A:
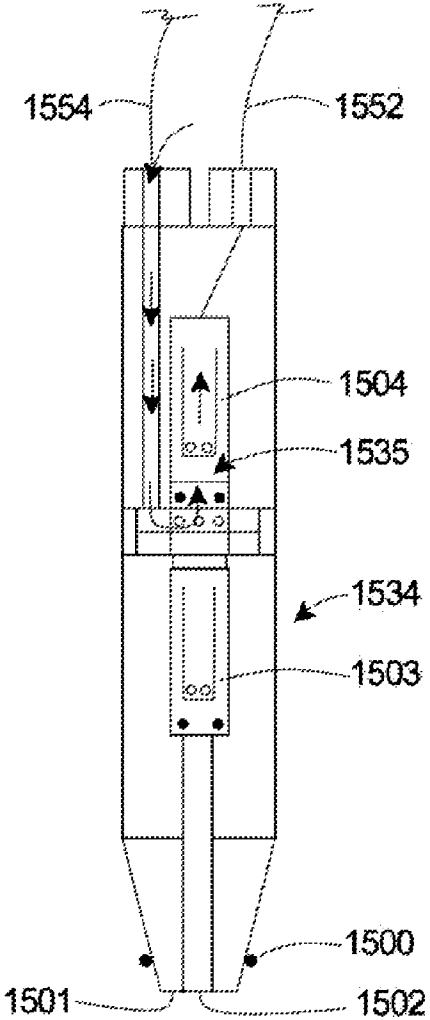

FIGS. 15A-B are schematic diagrams of one embodiment of the docking apparatus 1534, including a pump assembly 1535 and its operation within the system 10. With the designs provided herein, the pump assembly 1535 can draw fluid directly and exclusively from a sampling zone of interest, e.g., the first zone 22 (illustrated in FIG. 1D) below the docking receiver 32 (illustrated in FIG. 1D, for example), and can inhibit drawdown of fluid within the casing interior 26 (illustrated in FIG. 1D). Drawdown prevention is important in order to prevent dilution or pre-concentration effects from stagnant fluid in the casing 16 of the well 12.

The docking apparatus 1534 includes an o-ring 1500 positioned near an end 1501 of the docking apparatus 1534 to allow the weight of the docking apparatus 1534 and any attached equipment above the docking apparatus 1534 to produce a fluid-tight seal with the docking receiver 32. In one embodiment, the end 1501 of the docking apparatus 1534 that seats with the docking receiver 32 includes a hole 1502 or a protruding tube to allow fluid to flow directly from the first zone 22 through the docking receiver 32 into the docking apparatus 1534. The fluid then fills the sample return line 1552 and the gas in line 1554 up to the equilibrium point as determined by the pressure within the fluid formation.

In FIG. 15A, the pump assembly 1535 includes a first valve 1503 and a second valve 1504. During purging, the first valve 1503 is seated and the second valve 1504 is open, as illustrated in FIG. 15A. During recharge, the first valve 1503 is open and the second valve 1504 is seated, as illustrated in FIG. 15B, and fluid 1525 (represented by two arrows) is allowed to flow into the pump assembly via the docking receiver 32 and fluid receiving pipe 28 (illustrated in FIG. 1D).

Figure 16C:
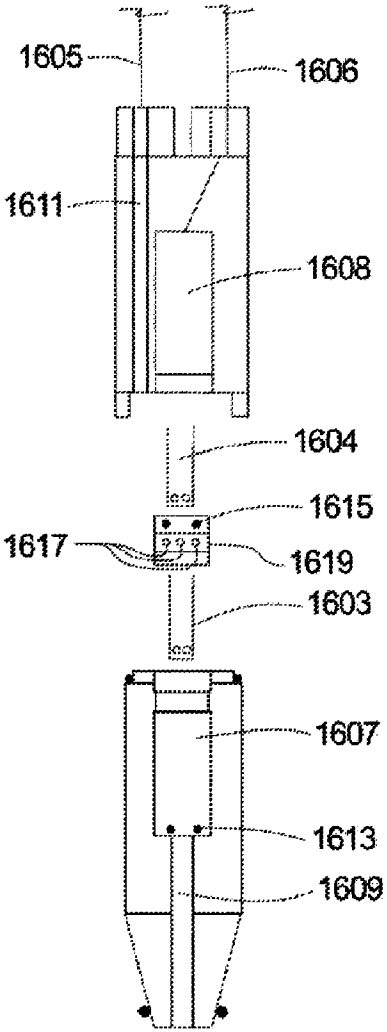
FIGS. 16A-C illustrate various views of one embodiment of the pump assembly.
Figure 16B:
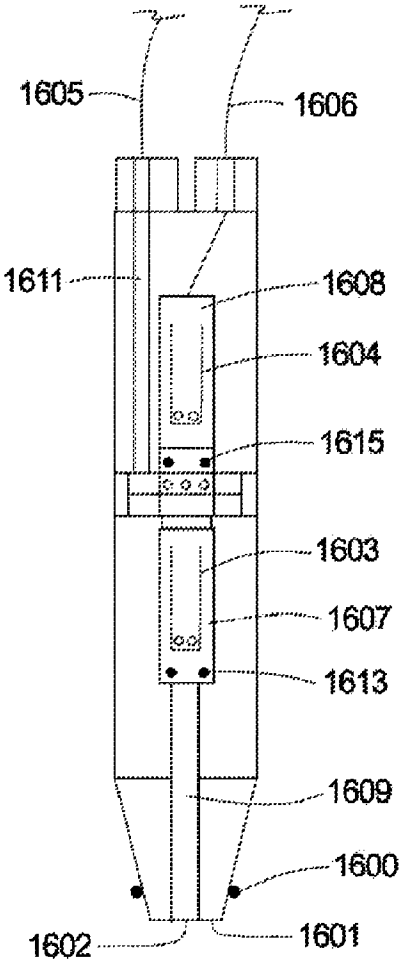
Figure 16A:
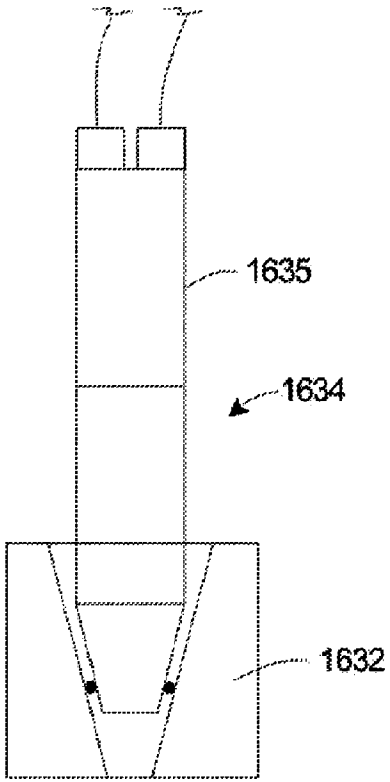

FIGS. 16A-C illustrate various views of one embodiment of the pump assembly 1635. In this embodiment, the pump assembly 1635 includes a first valve 1603, a second valve 1604, a first tubing 1605, a second tubing 1606, a first cavity 1607, a second cavity 1608, a first channel 1609 and a second channel 1611. The first valve 1603 prevents displacement of fluid back into the casing 16 (illustrated in FIG. 1D) while pneumatic pressure is applied to the first tubing 1605. The second valve 1604 prevents sample fluid from dropping back down the sample return tubing or pipe during repeated pumping cycles. The first valve 1603 and the second valve 1604 (for example, balls or poppets) move freely up and down within the first cavity 1607 and the second cavity 1608, respectively.

Each cavity 1607, 1608 has an o-ring 1613, 1615, respectively, or sealing seat at a lower end of the cavity.

Fluid introduced from below the docking receiver 1632 (FIG. 16A) flows through the hole 1602 at the end 1601 of the docking apparatus 1634 into the first channel 1609. Fluid flows through the first channel 1609 then through the first valve 1603 then through one or more perforated holes 1617 in a connector 1619 that connects the first cavity 1607 to the second cavity 1608.

In one embodiment, operating the pump assembly 1635 of the docking apparatus 1634 can include one or more of the following steps:

1. Pneumatic pressure is applied through the first tubing 1605. The first valve 1603 closes to prevent fluid in the first tubing 1605 from being pushed back into the first zone 22 (illustrated in FIG. 1D). Sample fluid in the first tubing 1605 and the second tubing 1606 is pushed toward the ground surface.
2. After fluid in the first tubing 1605 is pushed to the depth of the first valve 1603, pneumatic pressure is released from the first tubing 1605.
3. The second valve 1604 closes to prevent fluid in the second tubing 1606 from descending back into the first zone 22 below the docking receiver 1632.
4. Fluid from the first zone below the docking receiver 1632 rises to an equilibrium point within the first tubing 1605 as determined by pressure from the first zone below the docking receiver 1632.
5. Pneumatic pressure is reapplied to the first tubing 1605 and the cycle is repeated. Fluid is returned to the surface in a stream without the introduction of the pneumatic lifting agent to the purged fluid. The pneumatic lifting agent is typically pressurized gas such as nitrogen or ambient air; other fluids may also be used, such as oil or another agent to which pressure can be applied.

The o-ring 1600 between the docking apparatus 1634 and the docking receiver 1632 allows the entire docking apparatus 1634 to be removed easily by retracting the first tubing 1605 and/or the second tubing 1606 attached to the pump assembly 1635.

Figure 17D:
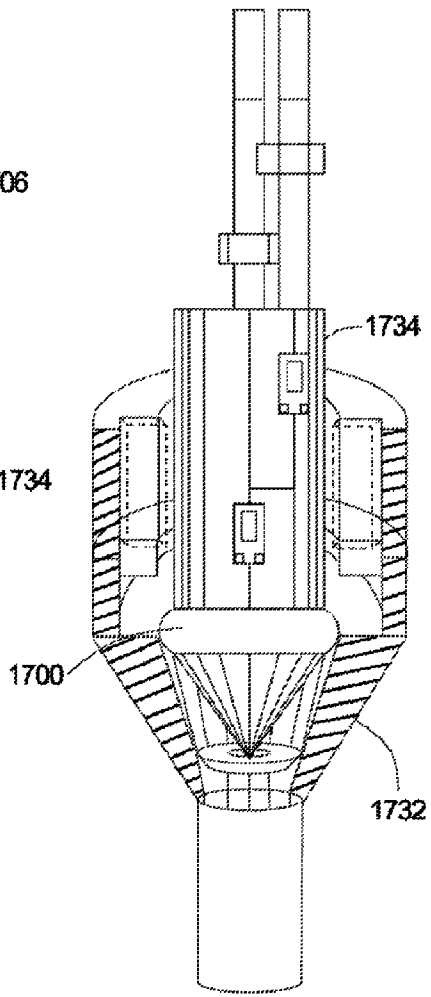
FIGS. 17A-D illustrate various views of a docking apparatus and a docking receiver having features of the present invention.
Figure 17C:
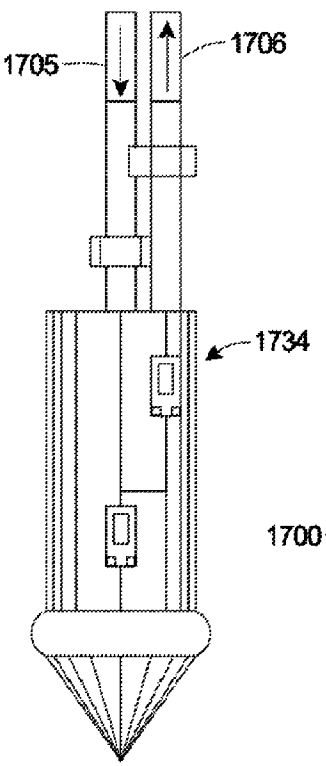
Figure 17B:
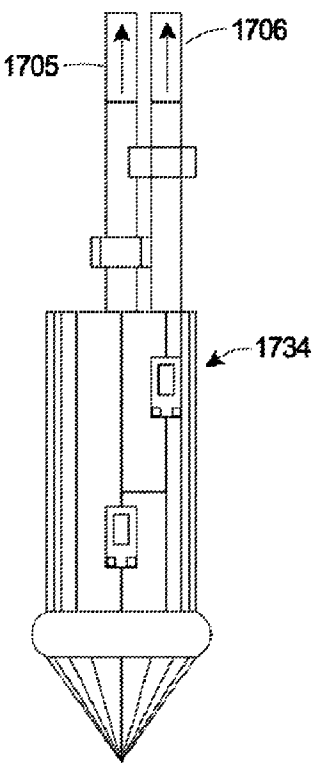
Figure 17A:
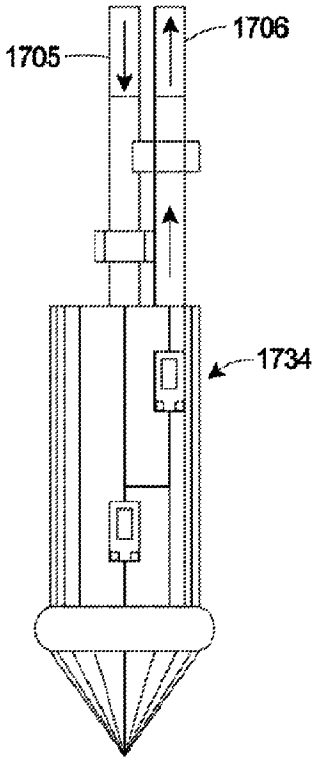

FIGS. 17A-C illustrate various views of a docking apparatus 1734 during purge and recharge cycles. FIG. 17A illustrates a typical purge cycle during which gas enters from the first tubing 1705 to force fluid through the second tubing 1706 up the ground surface. FIG. 17B illustrates a typical recharge cycle during which fluid from the first zone is allowed to equilibrate within the pump assembly 1735 and into the first tubing 1705 and the second tubing 1706. FIG. 17C again shows the transition to the purge cycle.

FIG. 17D illustrates the docking apparatus 1734 in the docked position with the docking receiver 1732, with the o-ring 1700 firmly seated in a fluid-tight manner with the docking receiver 1732.

Figures 18A, 18B, 18C:
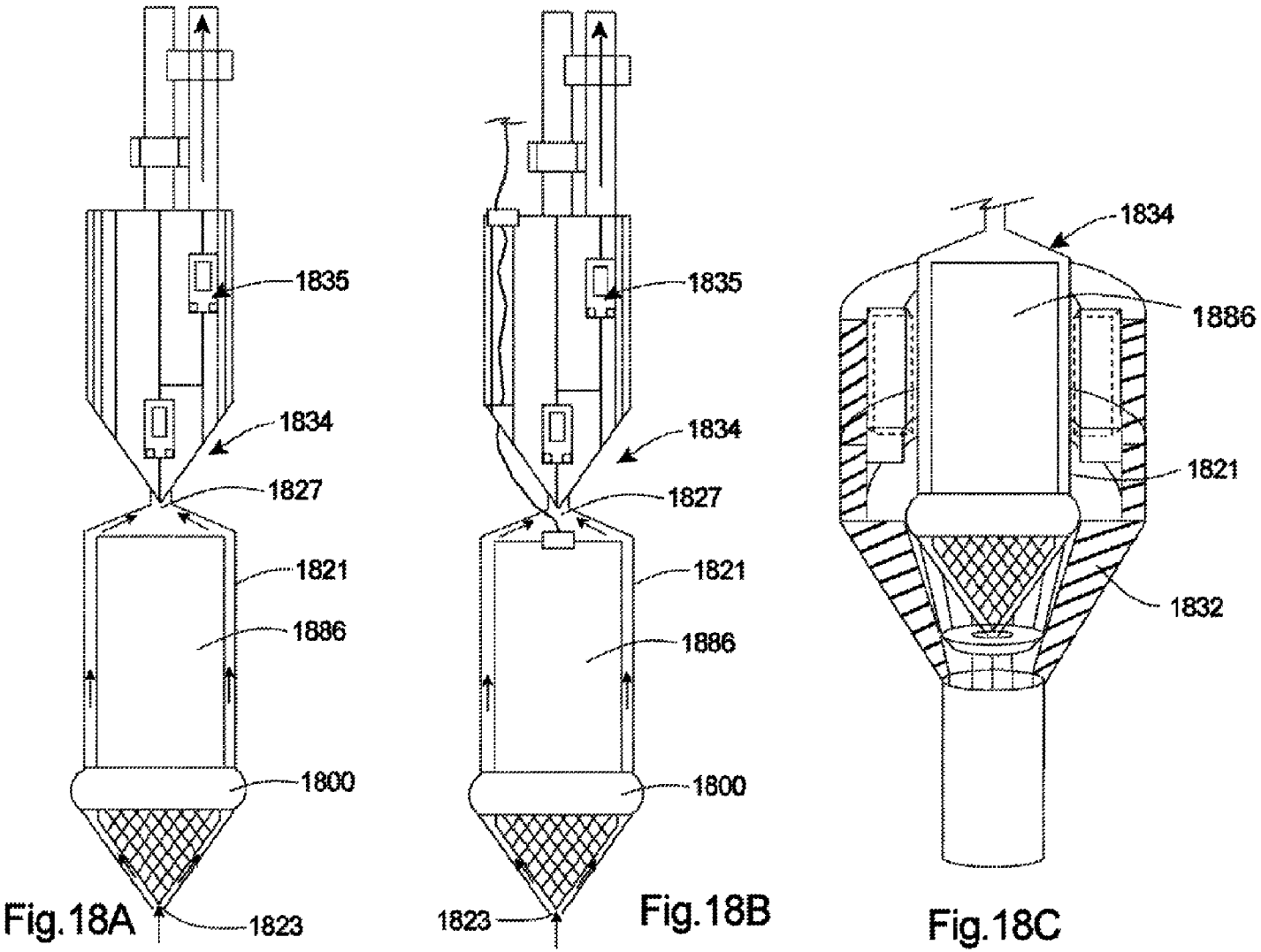
FIGS. 18A-C illustrate schematic views of an embodiment of the docking apparatus and the docking receiver.

FIGS. 18A-B illustrate schematic views of another embodiment of the docking apparatus 1834. FIG. 18C is a perspective view of the docking apparatus in FIGS. 18A-B that is docked with a docking receiver 1832. The docking apparatus 1834 includes a housing 1821 and a sensor apparatus 1886. The housing 1821 is designed to house the sensor apparatus 1886, and has one or more intake ports 1823 that substantially do not allow fluid to enter the housing 1821 from an upper portion of the well 12 (illustrated in FIG. 1D) above the docking receiver 1832 (illustrated in FIG. 18C) when the housing 1821 is docked with the docking receiver 1832. In one configuration, when the housing 1821 is fully docked with the docking receiver 1832, the o-ring 1800 at the end of the housing 1821 seals the end opening of the housing 1821 against a fluid intake area of the docking receiver 1832. This isolates the sensor apparatus 1886 and allows it to detect parameters such as temperature and pressure, for example, directly within the first zone 22 (illustrated in FIG. 1D) below the interconnected docking receiver 1832.

The docking receiver 1832 can be used to integrate sensors 1886 to detect and record well parameter data directly from the first zone 22. The sensor 1886 could be deployed without a sampling system, or with an integrated sampling system. Summary features can include one or more of the following:

1. Docking receiver 1832 designed for partial retraction of sensor 1886 to allow fluid transfer from the docking receiver 1832 opening to fluid intake ports 1823 on housing 1821 above the o-ring 1800.
2. Single or multiple upper o-rings (not shown in FIGS. 18A-B) above the fluid intake ports 1823 on housing 1821 to seal the upper portion of the housing 1821 against the docking receiver 1832 to reduce the likelihood of fluid from casing from entering the fluid intake ports 1823 below the upper o-rings.
3. Sensor integration to allow fluid to pass through the docking receiver 1832 and the housing 1821 into the pump assembly 1835 while sensor 1886 is seated in the docking receiver 1832.

When the docking apparatus 1834 is retracted to disengage the o-ring 1800 at the end opening from the docking receiver 1832, fluid flows from the docking receiver 1832 opening into the intake ports 1823 above the o-ring 1800. An o-ring seal around the end of the sensor 1886 inside the housing 1821 reduces the likelihood of back-flow of fluid past the sensor 1886 and out the end opening. The fluid then moves up and around the sensor 1886 within the housing 1821 to an outtake port 1827 at the top of the housing 1821.

Figure 19D:
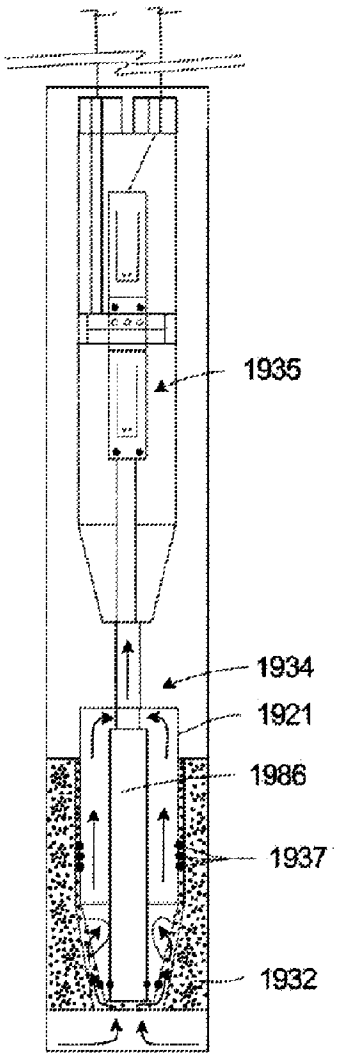
FIGS. 19C-D illustrate cross-sectional schematic side views of the docking apparatus illustrated in FIG. 19B, docked with a docking receiver.
Figure 19C:
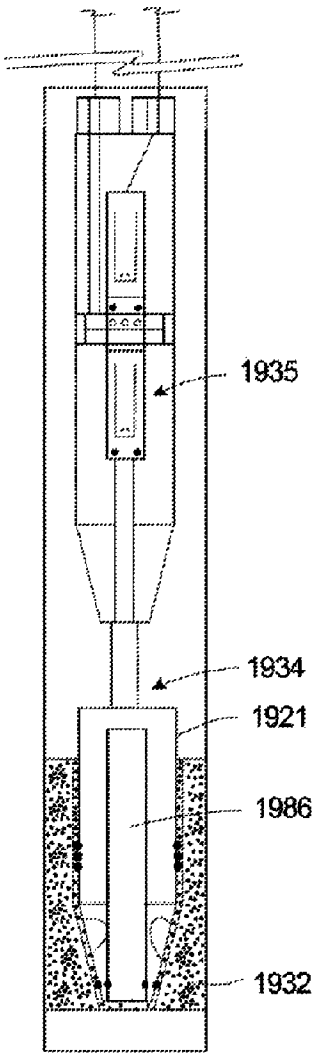
Figure 19B:
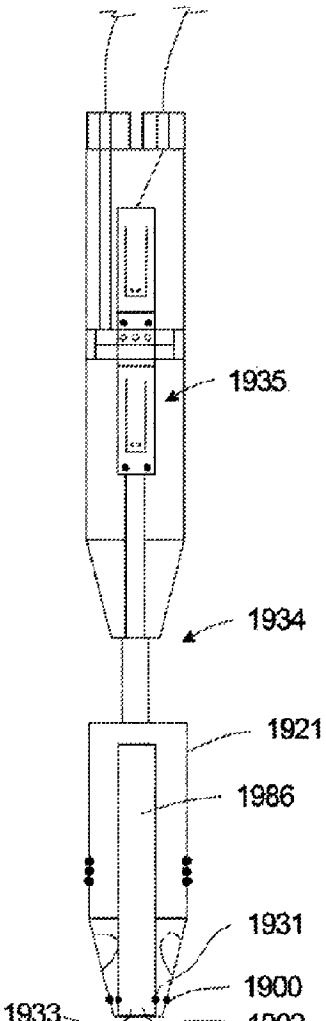
FIG. 19B is a cross-sectional schematic side view of the docking apparatus illustrated in FIG. 19A.
Figure 19A:
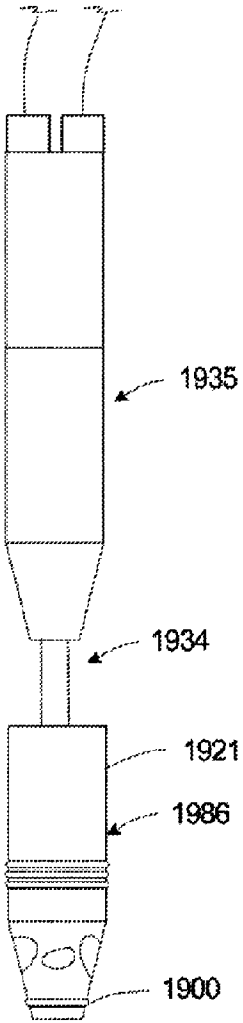
FIG. 19A is a simplified side view of a portion of another embodiment of the docking apparatus

FIG. 19A is a side view of a portion of another embodiment of the docking apparatus 1934, including a pump assembly 1935 and a sensor apparatus 1986. FIG. 19B is a cross-sectional schematic side view of the docking apparatus 1934 illustrated in FIG. 19A. FIGS. 19C-D illustrate cross-sectional schematic side views of the docking apparatus 1934 illustrated in FIG. 19B, docked with a docking receiver 1932.

In this embodiment, the sensor 1986 (with or without integrated data storage capability) remains seated in the docking receiver 1932 (illustrated in FIG. 18C) with fluid flowing past the sensor 1986, through the housing 1921, and into the pump assembly 1935. The sensor 1986 can detect parameters (temperature, pressure, etc.) within the fluid passing through the docking receiver 1932, including fluid within the tubing above the pump assembly 1935. This allows the pressure sensor 1986 to function as a fluid level sensor within the well 12 (illustrated in FIG. 1D). The pump assembly 1935 can be attached to an outtake port at the top of the housing 1921 to deliver the fluid to the ground surface.

In the retractable system used for isolating the sensor to detect parameters only in the first zone 22 (illustrated in FIG. 1D) below the docking receiver 1932, when engaged within the docking receiver 1932, a double o-ring system around the housing 1921 allows sensor docking in the fully-deployed position, and fluid extraction in the partially-retracted position.

As illustrated in FIG. 19B, the docking apparatus 1934 includes an o-ring 1931 between the sensor 1986 and the housing 1921 to isolate an end 1933 of the sensor 1986 in contact with the hole 1902 into the housing 1921.

As illustrated in FIG. 19C, when deployed to the desired depth within the well 12, the o-ring 1900 between the docking apparatus 1934 and the docking receiver 1932 isolates the sensor 1986 to detect only conditions within the first zone 22 (illustrated in FIG. 1D).

As illustrated in FIG. 19D, after partial retraction of the docking apparatus 1934 from the docking receiver 1932, one or more o-ring seals 1937 (three o-ring seals 1937 are illustrated in FIG. 19D) between the housing 1921 and the docking receiver 1932 isolate the fluid entry path. Stated another way, fluid can only enter the housing 1921 via below the docking receiver 1932, and not from above the docking receiver 1932.

Figure 20:
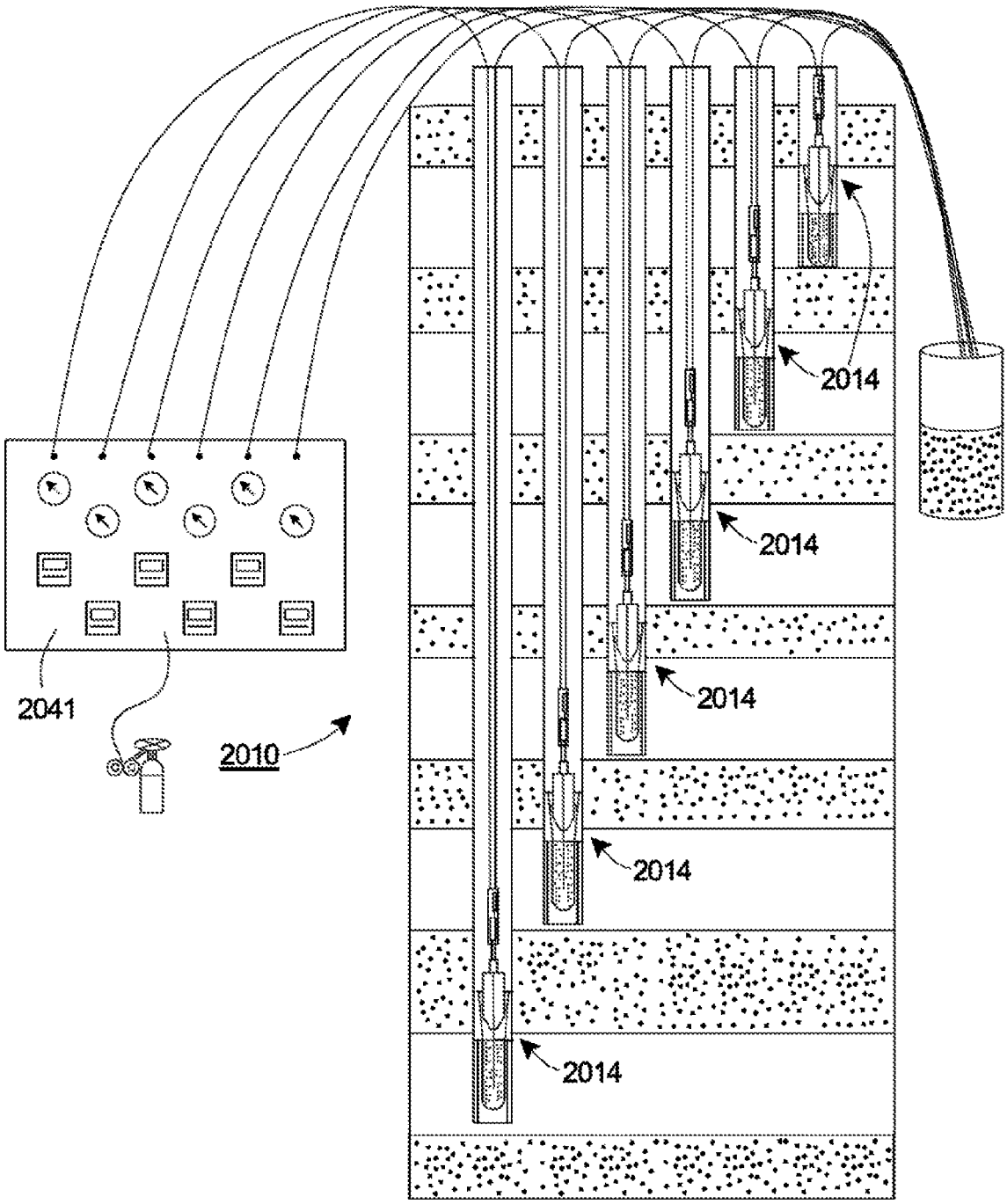
FIG. 20 is a schematic view of one embodiment of the fluid monitoring system.

FIG. 20 illustrates a schematic view of another embodiment of the fluid monitoring system 2010. The zone isolation assemblies described herein and within U.S. patent application Ser. No. 11/651,647 filed on Jan. 9, 2007, by Noah R. Heller et al. and assigned to BESST, Inc., entitled "Zone Isolation Assembly Array for Isolating a Plurality of Fluid Zones In a Subsurface Well", which are installed in multilevel configurations, or installed in close proximity to one another, can be operated individually or simultaneously, as illustrated in FIG. 20. The simultaneous capability provides significant efficiencies in time savings.

Subsurface wells that include one or more zone isolation assemblies 2014 and/or other well technologies described in this application can be operated independently or simultaneously using a controller 2041 with capability to operate multiple well systems. The controller 2041 may contain multiple timers, pressure regulators, air compressors, compressed gas tanks, fittings, and other equipment typically used for well system operation.

It is recognized that the various embodiments illustrated and described herein are representative of various combinations of features that can be included in the fluid monitoring system 10 and the zone isolation assemblies 14. However, numerous other embodiments have not been illustrated and described as it would be impractical to provide all such possible embodiments herein. It would be well within the purview of the present invention to combine one feature from one embodiment with another feature from another embodiment described herein. As one non-exclusive example, the volume displacer 1161A can be included in other embodiments shown and described herein, even though the volume displacer 1161A is only illustrated and described relative to FIG. 11A. As a further non-exclusive example, the controller 2041 can be utilized with various single-well embodiments illustrated and described herein, and is not limited to multiple-well embodiments.

It is to be further understood that an embodiment of the zone isolation assembly 14 can include any of the sealers 30, docking receivers 32, docking apparatuses 34, fluid collectors 462, pump assemblies 35, volume displacers 1161A, sensor apparatuses 1186C, and any of the other structures described herein depending upon the design requirements of the fluid monitoring system 10 and/or the subsurface well 12, and that no limitations are intended by not specifically illustrating and describing any particular embodiment.

While the particular fluid monitoring system 10 and zone isolation assemblies 14 as herein shown and disclosed in detail, are fully capable of obtaining the objects and providing the advantages herein before stated, it is to be understood that they are merely illustrative of various embodiments of the invention. No limitations are intended to the details of construction or design herein shown other than as described in the appended claims.

What is claimed is:

1. A zone isolation assembly for a fluid monitoring system in an existing subsurface well, the subsurface well including a casing and a fluid zone, the zone isolation assembly comprising:

a fluid receiving pipe including a pipe interior and a fluid inlet structure, the fluid receiving pipe receiving a fluid through the fluid inlet structure into the pipe interior;

a docking receiver that is connected to the fluid receiving pipe;

a docking apparatus that moves between (i) a docked position wherein the docking apparatus is docked with the docking receiver, and (ii) an undocked position wherein the docking apparatus is undocked with the docking receiver, the docking apparatus including a docking weight and a resilient seal positioned around a circumference of the docking weight to achieve a fluid-tight seal between the docking receiver and the docking apparatus; and a first sealer that is spaced apart from the docking apparatus, the first sealer selectively forming a fluid-tight seal between the fluid receiving pipe and the casing to divide the fluid zone into a first zone and a spaced apart second zone that is not in fluid communication with the first zone when the docking apparatus is in the docked position; the docking apparatus includes a pump assembly for moving the fluid away from the first zone.

2. The zone isolation assembly of claim 1 wherein the docking receiver is removably positioned within the casing.

3. The zone isolation assembly of claim 1 wherein the docking apparatus includes a sensor apparatus.

4. The zone isolation assembly of claim 1 wherein the first sealer is a time-release bentonite pellet bag.

5. The zone isolation assembly of claim 1 wherein the first sealer is an inflatable packer.

6. The zone isolation assembly of claim 1 wherein the first sealer includes a plurality of flanges that contact the casing.

7. The zone isolation assembly of claim 6 wherein at least one of the flanges has an angled contact region that contacts the casing so that the flange is angled relative to the casing.

8. The zone isolation assembly of claim 1 wherein the fluid receiving pipe has a diameter that varies along a length of the fluid receiving pipe.

9. The zone isolation assembly of claim 1 wherein the pipe interior includes a filling material that decreases a fluid volume within the pipe interior.

10. The zone isolation assembly of claim 9 wherein the filling material is sand.

11. The zone isolation assembly of claim 1 further comprising a second sealer that is spaced apart from the first sealer, the second sealer selectively forming a fluid-tight seal between the fluid receiving pipe and the casing so that the first zone is at least partially bounded by the second sealer.

12. The zone isolation assembly of claim 11 wherein the fluid receiving pipe is positioned substantially between the first sealer and the second sealer.

13. The zone isolation assembly of claim 11 wherein the docking apparatus is positioned substantially outside of the first zone.

14. The zone isolation assembly of claim 1 further comprising a deployment device that positions the docking receiver relative to the casing, the deployment device including an engagement pin that engages the docking receiver during positioning of the docking receiver relative to the casing.

15. The zone isolation assembly of claim 14 wherein the docking receiver includes a pin receiver that receives the engagement pin from the deployment device during engagement between the docking receiver and the deployment device.

16. The zone isolation assembly of claim 15 wherein the docking receiver includes a pin retainer, and the deployment device is adapted to be rotated so that the engagement pin is retained by the pin retainer during positioning of the docking receiver relative to the casing.

17. The zone isolation assembly of claim 1 further comprising a fluid collector that is coupled to the docking receiver, the fluid collector collecting the fluid for transport to the docking apparatus.

18. The zone isolation assembly of claim 1 wherein the first sealer includes a collapsing packer bag.

19. The zone isolation assembly of claim 18 further comprising a gas source positioned outside the well that inflates the collapsing packer bag to form the seal between the fluid receiving pipe and the casing.

20. The zone isolation assembly of claim 1 wherein the first sealer includes an upper section and a lower section that selectively engage one another to form the seal between the fluid receiving pipe and the casing.

21. The zone isolation assembly of claim 20 wherein the fluid receiving pipe is a telescoping fluid receiving pipe.

22. The zone isolation assembly of claim 1 further comprising a riser pipe that guides the docking apparatus toward the docking receiver, the riser pipe being secured to the docking receiver and extending from the docking receiver in a direction away from the first zone.

23. A fluid monitoring system including a controller and the zone isolation assembly of claim 1.

24. The zone isolation assembly of claim 1 wherein the resilient seal is a rubberized O-ring.

25. A zone isolation assembly for a fluid monitoring system in an existing subsurface well, the subsurface well including a casing and a fluid zone, the zone isolation assembly comprising:

a docking receiver that receives a fluid from the fluid zone;

a docking apparatus that moves between (i) a docked position wherein the docking apparatus is docked with the docking receiver, and (ii) an undocked position wherein the docking apparatus is undocked with the docking receiver, the docking apparatus including a docking weight and a resilient seal positioned around a circumference of the docking weight to achieve a fluid-tight seal between the docking receiver and the docking apparatus; and a first sealer that is spaced apart from the docking apparatus, the first sealer selectively forming a fluid-tight seal with the casing to divide the fluid zone into a first zone and a spaced apart second zone that is not in fluid communication with the first zone when the docking receiver is in the docked position; the docking apparatus includes a pump assembly for moving the fluid away from the first zone.

26. The zone isolation assembly of claim 25 wherein the docking receiver is removably positioned within the casing.

27. The zone isolation assembly of claim 25 wherein the docking apparatus includes a sensor apparatus.

28. The zone isolation assembly of claim 25 wherein the first sealer is a time-release bentonite pellet bag.

29. The zone isolation assembly of claim 25 wherein the first sealer includes a plurality of flanges that contact the casing.

30. The zone isolation assembly of claim 29 wherein at least one of the flanges has an angled contact region that contacts the casing so that the flange is angled relative to the casing.

31. The zone isolation assembly of claim 25 further comprising a volume displacer that is coupled to the first sealer.

32. The zone isolation assembly of claim 25 further comprising a fluid receiving pipe having a pipe interior that includes a filling material that decreases a fluid volume within the pipe interior.

33. The zone isolation assembly of claim 25 further comprising a second sealer that is spaced apart from the first sealer, the second sealer selectively forming a fluid-tight seal with the casing so that the first zone is at least partially bounded by the second sealer.

34. The zone isolation assembly of claim 25 further comprising a deployment device that positions the docking receiver relative to the casing, the deployment device including an engagement pin, the docking receiver including a pin receiver that receives the engagement pin during positioning of the docking receiver relative to the casing.

35. The zone isolation assembly of claim 25 further comprising a gas source positioned outside the well, wherein the first sealer includes a collapsing packer bag that is inflated by gas from the gas source to form the seal with the casing.

36. The zone isolation assembly of claim 25 wherein the first sealer includes an upper section and a lower section that selectively engage one another to form the seal with the casing.

37. A fluid monitoring system including a controller and the zone isolation assembly of claim 25.

38. The zone isolation assembly of claim 25 wherein the resilient seal is a rubberized O-ring.

39. A method for isolating a first zone from a second zone within a fluid zone of an existing subsurface well, the method comprising the steps of:

positioning a removable docking apparatus in a docked position with a docking receiver that is connected to a fluid receiving pipe within a casing of the existing well, the docking apparatus including a docking weight and a resilient seal positioned around a circumference of the docking weight to achieve a fluid-tight seal between the docking receiver and the docking apparatus; and forming a fluid-tight seal between the fluid receiving pipe and the casing so that the second zone is spaced apart from and is not in fluid communication with the first zone when the docking apparatus is in the docked position; the docking apparatus includes a pump assembly for moving a fluid away from the first zone.

* * * * *